US007158449B2

(12) United States Patent
Fujimori et al.

(10) Patent No.: US 7,158,449 B2
(45) Date of Patent: Jan. 2, 2007

(54) ELECTRONIC TIMEPIECE AND ELECTRONIC APPARATUS

(75) Inventors: Shigeyuki Fujimori, Chino (JP); Joji Kitahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 10/400,027

(22) Filed: Mar. 26, 2003

(65) Prior Publication Data

US 2004/0105347 A1 Jun. 3, 2004

(30) Foreign Application Priority Data

Mar. 27, 2002 (JP) ..... 2002-089631
Apr. 9, 2002 (JP) ..... 2002-107131
Mar. 18, 2003 (JP) ..... 2003-073915

(51) Int. Cl.
*G04C 11/02* (2006.01)
*G04F 5/00* (2006.01)
*G04B 1/00* (2006.01)

(52) U.S. Cl. ..... 368/47; 368/88; 368/160; 368/204; 368/281; 368/293

(58) Field of Classification Search ..... 368/47, 368/88, 281, 204, 80, 160, 293
See application file for complete search history.

(56) References Cited

U.S. PATENT DOCUMENTS 4,783,772 A * 11/1988 Umemoto et al. ..... 368/11
4,897,825 A * 1/1990 Ikenishi ..... 368/228
4,969,133 A * 11/1990 Triponez ..... 368/80
5,253,226 A * 10/1993 Ganter ..... 368/47
5,329,501 A * 7/1994 Meister et al. ..... 368/10
6,134,188 A 10/2000 Ganter et al.
6,173,164 B1 * 1/2001 Shah ..... 455/182.1
6,269,055 B1 * 7/2001 Pikula et al. ..... 368/47
6,385,133 B1 * 5/2002 Miyauchi ..... 368/10
2002/0183865 A1 * 12/2002 Ichikawa et al. ..... 700/15

FOREIGN PATENT DOCUMENTS

JP 11-64547 3/1999
JP 11-160464 6/1999
JP 2000-105285 * 4/2000

* cited by examiner

*Primary Examiner*—Vit W. Miska

(57) ABSTRACT

An electronic timepiece includes a radio wave receiving antenna (8) for receiving radio waves, electromagnetic motors (61, 65) for driving a time display part, a battery (5), and a body case for receiving the antenna (8), electromagnetic motors (61, 65), and the battery (5). The antenna (8), electromagnetic motors (61, 65), and the battery (5) do not overlap as viewed in the viewing direction of a time display part, that is, they do not overlap two-dimensionally. By such a structure, the electronic timepiece can be thin and flat.

18 Claims, 12 Drawing Sheets

ELECTRONIC TIMEPIECE AND ELECTRONIC APPARATUS

TECHNICAL FIELD

The present invention relates to an electronic timepiece and an electronic apparatus, and more specifically, it relates to an electronic timepiece and an electronic apparatus having a receiving mechanism for receiving wireless information.

BACKGROUND ART

As an electronic apparatus such as an electronic timepiece having a function for receiving wireless information, there is known, for example, a radio wave clock for receiving time information transmitted by wireless (standard radio waves) and performing time correction. Such a radio wave clock is normally driven by a battery, but since power is consumed in receiving radio waves, the size of the battery is increased compared with that of a normal clock, and there is a problem of requiring more often replacement of the battery. Further, there is a problem that its movement is also enlarged.

Because of this, a radio wave clock having a solar power-generation mechanism installed as a generating mechanism is known (for example, Japanese Unexamined Patent Application Publication No. 11-160464).

The radio wave clock having the solar power-generation mechanism includes a solar battery as the solar power-generation mechanism, a receiving mechanism having an antenna for receiving standard radio waves, and a time-measuring mechanism for measuring time, and the time of the time-measuring mechanism is corrected according to the standard radio waves received by the antenna.

By such a structure, the time-measuring mechanism and the receiving mechanism can be driven by using the power generated by the solar power generation mechanism. Therefore, only if the solar battery generates power and is charged by solar light, can it be used as a radio wave clock driven semi-permanently.

However, efficient solar power generation cannot be assured since it is dependent on conditions such as daylight amount (for example, cloudy or rainy weather), seasons (for example, winter), and regions (for example, high latitude region), and so it sometimes cannot supply power. The radio wave clock needs a large amount of power since the received time information should be processed (amplification, demodulation) by the receiving mechanism. Because of this, if sufficient power is not supplied to the receiving mechanism, the standard radio waves cannot be received, or the standard radio waves are wrong-received, and therfore the receiving sensitivity of the receiving mechanism is decreased. Further, there is a problem that rapid charge is impossible in the solar battery if a receiving light energy is weak.

Because of this, the radio wave clock having the solar power-generation mechanism is not necessarily a convenient clock.

Therefore, the inventor of the present invention studied a method of installing a power-generation mechanism inside a radio wave clock, for converting mechanical energy to electrical energy. The power-generation mechanism for converting mechanical energy to electrical energy includes, for example, a winding stem for inputting mechanical energy from the outside and a generator for converting the mechanical energy from the winding stem to electrical energy. The generator includes a rotor that is rotated by the mechanical energy and a generating coil that generates electrical energy from the change of magnetic flux that accompanies the rotation of the rotor. By using such a structure, for example, if mechanical energy is input by the method of rotating the winding stem, etc., the power generation can be performed whenever necessary. Therefore, compared with the solar power generation, method, since in the present method power generation is possible regardless of the conditions of seasons, daylight amount, regions, etc., the present method provides an advantage that rapid power generation can be much easily performed.

However, when power generation occurs by use of the generating coil, a magnetic field is generated by the generating coil. An antenna is affected by the magnetic field generated by the generating coil with standard radio waves. Therefore, when standard radio waves are received by the antenna, if the magnetic field from the generating coil overlaps the antenna, the signal of the standard radio waves is deformed by the influence of the magnetic field, the standard radio waves cannot be received or are wrong-received. That is, if a power-generation mechanism for converting mechanical energy to electrical energy is just simply installed inside the radio wave clock, there occurs a new problem that standard radio waves cannot be received.

Such a problem is not limited to an electronic timepiece having a radio wave correction function, and is a common problem which can be applied to various electronic apparatuses including a power-generation mechanism for converting mechanical energy to electrical energy and an antenna receiving wireless information from the outside.

Therefore, in a configuration of the radio wave clock, it is necessary to install a battery having storage capacitance enough to supply the power consumed by the receiving operation, the receiving antenna, or the receiving circuit further to a time-measuring mechanism or an electromagnetic motor. In a portable electronic timepiece such as a wristwatch, the thickness is required to be as thin as possible to improve the installation or design characteristics, and the thin thickness is required in a radio wave clock having a receiving antenna.

As a structure for the radio wave clock having a thin thickness, Japanese Unexamined Patent Application Publication No. 2000-105285 discloses a structure in which the antenna is disposed on almost the same section with a module for performing the function as a portable electronic timepiece. Also, Japanese Unexamined Patent Application Publication No. 11-64547 discloses a structure in which an antenna core is extended along the end of a print circuit substrate in the placement of the antenna core and the electronic module circuit substrate. However, since the components for the module and the placement with the antenna are not disclosed, it is difficult to make the radio wave clock thin.

An object of the present invention is to solve the problem as above, and to provide an electronic timepiece and an electronic apparatus being capable of receiving wireless information from the outside with a power-generation mechanism therein.

Another object of the present invention is to provide an electronic timepiece capable of receiving wireless information from the outside with a thin thickness and a small size.

SUMMARY OF INVENTION

An electronic timepiece of the present invention includes a radio wave receiving antenna for receiving radio waves, at least one electromagnetic motor for driving a time display part, at least one power source, and a base frame having the radio wave receiving antenna, the electromagnetic motor, and the power source installed thereon, and the projection images projecting the antenna, the electromagnetic motor, and the power source are separated from one another in the viewing direction of the time display part.

By such a structure, the antenna for receiving radio waves, the electromagnetic motor, and the power source are placed not to overlap in the thickness direction of the electronic timepiece. In the clock, the antenna, the motor, and the power source are components as components, being the largest in thickness, and if these components do not overlap in the thickness direction of the clock, the thickness of the electronic timepiece can be made thinnest. As a result, when making the electronic timepiece a portable clock such as a wrist clock, the design and installation characteristics can be improved.

Here, the base frame may be a member having the antenna, the motor, and the power source installed thereon, and is normally composed of a base plate or a back lid. Further, the base frame may be made a one-piece type in which a dial, a body case, and the back lid are integrally formed, or the back lid and a band for arm wearing are integrally formed, or the body case, the back lid, and the band are integrally formed.

An electronic timepiece of the present invention is preferably configured such that the antenna, the electromagnetic motor, and the power source are formed on the same plane almost perpendicular to the viewing direction of the time display part.

By such a structure, since large components of the clock, that is, the antenna, the electromagnetic motor, and the power source are placed on the same plane further to the structure that they do not overlap each other, the thickness of the clock is the same as that of the component being the thickest among the antenna, the electromagnetic motor, and the power source so that the clock can be made as thinnest as possible.

Here, the antenna for receiving radio waves, the electromagnetic motor, and the power source are preferably installed at the same height. Further, the electromagnetic motor includes a first electromagnetic motor and a second electromagnetic motor, and the antenna for receiving radio waves, the electromagnetic motor, the power source, the first electromagnetic motor, and the second electromagnetic motor are preferably placed at the same height. Further, the clock may include a crystal oscillator for generating a reference clock.

The antenna for receiving radio waves, the electromagnetic motor, the power source, and the crystal oscillator are preferably placed at the same height. Further, the antenna for receiving radio waves, the electromagnetic motor, and the power source are preferably placed on the same surface as the base frame.

The placement on the same surface as the base frame also include the case that when the base frame is curved-shaped, the antenna for receiving radio waves, the electromagnetic motor, and the power source are placed along the curved surface of the base frame as well as the case that the antenna for receiving radio waves, the electromagnetic motor, and the power source are placed on the same plane (plane surface perpendicular to the thickness direction of the clock). For example, a very thin clock, being several mm in thickness, ensures the internal space and realizes the thin-flatness by curving the back lid or base plate, etc. along the curved surface of arms. In such a clock, the installation surface of the back lid or the base plate, in which the antenna for receiving radio waves, the electromagnetic motor, and the power source are installed, is also curved along the shape of the curved surface of arms, but such the case that they are not placed on the same plane is included in the case that they are placed on the same plane as the base frame. By such a placement, the electronic timepiece can be seen very thin from the view of its lateral side.

Further, since the core of the antenna for receiving radio waves is buried in the base frame, even the case that its grounding surface is placed on the same plane as the installed surface of the power source or the electromagnetic motor is included in the case of being installed on the same surface as the base frame. Further, when burying the core of the antenna for receiving radio waves in the base frame, if the base. frame is composed of a plastic material, its strength can be increased.

Further, the case that the installation surface of the core of the antenna for receiving radio waves, the installation surface of the power source, and the installation surface of the electromagnetic motor follow the curved surface of arms, that is, the curved surface of the base frame is included in the case of installing on the same surface of the base frame. That is, the case of installing on the same surface as the base frame also includes the case that the antenna for receiving radio waves, the electromagnetic motor and, the power-source are placed such that the distance between the bottom surface of the base frame and the installation surface of the core of the antenna for receiving radio waves, the distance between the bottom surface of the base frame and the installation surface of the power source, and the distance between the bottom surface of the base frame and the installation surface of the electromagnetic motor are almost the same.

That is, the installation on the same surface as the base frame means that the antenna for receiving radio waves, the electromagnetic motor, and the power source are placed not to overlap in the thickness direction of the electronic timepiece. That is, the antenna for receiving radio waves, the electromagnetic motor, and the power source are preferably placed such that their plane locations (locations of the plane direction perpendicular to the thickness direction of the electronic timepiece) are different from each other for the base frame.

The electromagnetic motor can employ a stepping motor, etc. The hour hand, the minute hand, and the second hand can be driven by using three individual motors respectively. In the case that the time display part includes the hour hand, the minute hand, and the second hand for displaying time, the electromagnetic motor may include two motors, that is, a second hand driving motor and a minute/hour hand driving motor. In this case, the minute/hour hand driving motor may be preferably placed further apart from the antenna for receiving radio waves than the second hand driving motor. By the installation as above, when the antenna for receiving radio waves receives radio waves, the second hand driving motor can stop its driving, but the minute/hour hand driving motor can keep its driving. Even though the minute/hour hand driving motor keeps its driving, if the minute/hour hand driving motor is separated from the antenna for receiving radio waves, the magnetic field generated from the minute/hour hand driving motor hardly affects the antenna for receiving radio waves. Therefore, the erroneous reception in receiving radio waves is prevented by stopping the second hand driving motor close to the antenna, and current time for the minute/hour important as time information can be always displayed.

In the case that the electromagnetic motor includes two motors of the second hand driving motor and the minute/hour hand driving motor, the minute/hour hand driving motor is preferably formed to have higher antimagnetic performance than the second hand driving motor. If the antimagnetic performance of the minute/hour hand driving motor is higher, the minute/hour display, being very important in displaying time, can be maintained very precisely.

Here, to increase the antimagnetic performance, in the case that the shapes of the coil cores are the same, for example, the number of ampere turns of the coils can be increased. If the number of ampere turns of the coils is increased, there is more advantage of saving the energy in driving the motors as well as improving the antimagnetic performance. Because of this, if the remained storage in the secondary battery as the power source is small, the driving of the second hand driving motor stops, and the time display by the minute/hour hand driving motor is performed to display-only minute/hour so as to reduce the energy consumption.

As the power source, it will be possible to include any one of a primary battery, a secondary battery, or an electromagnetic generating mechanism, etc. Further, the number of the power source of the primary battery, the secondary battery, or the electromagnetic generating mechanism, etc. is not limited to one, but plural number is possible.

An electronic timepiece of the present invention is preferably configured such that the antenna and the power source are separated from each other, with the electromagnetic motor placed between them. Further, the antenna and the power source are more preferably placed to face each other on the opposite sides with the electromagnetic motor between them.

If the components of the clock, being large in size, are placed closely to each other on the base plate, the strength of the region having a large component of the clock installed thereon becomes weak. Then, the clock is vulnerable to the shock such as downfall or the like. Therefore, it is preferable to install large components of the clock apart from each other, and the antenna and the power source are separated from each other. Then, the electromagnetic motor is installed in the space between the antenna and the power source generated by installing the antenna and the power source apart from each other. Then, since the magnetic field from the power source is shielded by the coil core of the electromagnetic motor, it is possible to make a structure that the magnetic field from the power source does not affect the antenna. Further, since the external magnetic field is shielded before the electromagnetic motor by the antenna core, the external magnetic field does not affect the operation of the electromagnetic motor. Therefore, the electromagnetic motor can operate exactly.

If the base frame is a base plate, the antenna and the power source are preferably installed along the peripheral part of the base plate. The placement of the antenna along the peripheral part of the base plate may include the case that the both ends of the antenna core are placed along the peripheral part of the base plate, or the case that the curved-shaped coils are placed along the peripheral part of the base plate. As such, if the both ends of the rod-shaped core are placed along the peripheral part of the base plate, the number of turns of coils can be increased in the limited space. Further, preferably, in the base frame is there installed an opening portion or a concave portion in the location corresponding to the coils. Then, even though the number of turns of coils is increased, and the outer look of the coil winding looks thick, the coils can be placed in the base frame.

Here, the outer look of the base plate is not limited to a circular shape, but any shape such as an elliptic shape or a track shape, a rectangular shape, etc. can be possible, and it is determined by the design of the clock.

A button-shaped battery is used as the power source, and at least part of the peripheral part of the battery preferably follows the peripheral part of the base plate. If the battery is a secondary battery in which charge and discharge are possible, the electromagnetic field from the battery is changed by the change of the voltage when charging and discharging the battery. However, by placing the antenna for receiving and the battery separated as apart as possible from each other, the impact of the electromagnetic field from the battery hardly affects the antenna, and the receiving sensitivity of the antenna can be maintained good.

Further, the power source can employ a primary battery or a secondary battery, the shape of which is possibly deformable such as curvature or bending, and is composed of solid electrolyte. By doing so, the layout of the movement can be made freely regardless of the shape of the battery.

Further, an opening portion or a concave portion may be preferably formed in the location corresponding to the power source on the base plate. By such a structure, even though the size of the power source becomes large, it can be installed on the base plate, and the capacitance of the battery can be increased.

In the electronic timepiece of the present invention, the electromagnetic motor includes a first electromagnetic motor for minute/hour hand driving and a second electromagnetic motor for second hand driving, and the power source and the antenna are placed such that the first electromagnetic motor and the second electromagnetic motor are placed therebetween, and the antenna, the power source, the first electromagnetic motor and the second electromagnetic motor are preferably placed on the same plane.

By such a structure, there are two electromagnetic motors, that is, the first electromagnetic motor and the second electromagnetic motor, and the magnetic field from the power source is surely shielded before the antenna by the two electromagnetic motors. As a result, the receiving sensitivity of the antenna can be improved.

In the electronic timepiece of the present invention, a time correction mechanism having the winding stem is placed along the peripheral part of the base plate, and the electronic timepiece includes a time-measuring control circuit for controlling the electromagnetic motor, and the projection images projecting the time-measuring control circuit and the time correction mechanism in the viewing direction of the time display part overlap at least partially, and the projection images projecting the power source, the electromagnetic motor, and the antenna in the viewing direction of the time display part are preferably separated from each other.

In such structure, since the time-measuring control circuit, for example, an IC for measuring time is relatively thin, 0.1 mm to 0.3 mm, even though the control portion is placed to overlap the time correction device, it does not affect the thickness of the electronic timepiece. Therefore, by stacking the control portion and the time correction mechanism, the electronic timepiece can be minimized.

In the electronic timepiece of the present invention, there is provided a wheel train for transmitting driving energy of the electromagnetic motor on the hands for time display, and the wheel train is preferably placed in almost the center of the base frame. By such a structure, the rotation center of the hands may be almost the center of the clock. Then, the rotation radius of the hands can be increased. As a result, the time display can be visually made.

In the electronic timepiece of the present invention, there are provided a tuning-signal crystal oscillator for generating tuning signals tuned to the radio waves, and a reception processing circuit for processing the radio waves received by the antenna, and the tuning-signal crystal oscillator and the reception processing circuit are placed closely each other, and the projection images projecting the tuning-signal crystal oscillator, the power source, the antenna, and the electromagnetic motor in the viewing direction of the time display part are separated from each other, and the projection images projecting the reception processing circuit, the tuning-signal crystal oscillator, the power source, the antenna, and the electromagnetic motor in the viewing direction of the time display part are preferably-separated from each other.

By such a structure, since the tuning-signal crystal oscillator and the reception processing circuit are placed closely, the stray capacitance of-wiring connecting both components is reduced, and time-measuring deviation can be prevented. Further, since the wiring distance between both components is short, the energy for transmitting signals can be reduced and the saving of energy is achieved.

Here, the tuning-signal crystal oscillator is preferably placed on the same plane as the power source, the antenna, and the electromagnetic motor. Further, the time-measuring crystal oscillator for generating reference clock signals is preferably placed on the same plane as the tuning-signal crystal oscillator, the power source, the antenna, and the electromagnetic motor. By such a structure, thin-flatness of the clock on the whole can be facilitated from the non-overlapping of the components. Further, the time-measuring control circuit and the reception processing circuit can be installed in a separate body, or integrally installed in one IC, etc.

Further, the time-measuring crystal oscillator can be installed to be separated from the time-measuring control circuit. For example, the electromagnetic motor can be installed between the time-measuring crystal oscillator and the time-measuring control circuit.

As such, in the case that the time-measuring crystal oscillator and the time-measuring control circuit are separated from each other, there is a possibility of causing a time-measuring deviation since the stray capacitance in the wiring connecting both components is increased, but time can be corrected according to the time information by received radio waves. Therefore, time can be clocked exactly, and the free degree of the layout can be improved.

Further, the tuning-signal crystal oscillator is preferably placed along the peripheral part of the base plate. In the case that the radio waves is transmitted by different frequency, the tuning-signal crystal oscillator can be installed by two or more than two, corresponding to the different frequency, for example, in the case that the radio waves is standard radio waves, crystal oscillators for 40 kHz and 60 kHz can be installed respectively. And, the tuning-signal crystal oscillator for 40 kHz and the tuning-signal crystal oscillator for 60 kHz are preferably installed along the peripheral part of the base plate. Then, since the crystal oscillator is installed along the peripheral part of the base plate, the crystal oscillator can be installed by plurality. As a result, since radio waves of different frequency can be received, the convenience can be improved.

In the electronic timepiece of the present invention, the power source and the time correction device are placed closely each other, and installed along the peripheral part of the base plate, and preferably, the antenna and the power source are separated from each other by a predetermined distance, and the antenna and the time correction mechanism are separated from each other by a predetermined distance.

In such structure, since the components of the time correction mechanism, such as a winding stem, etc. is composed of a steel material of a high strength for thin-flatness and miniaturization, the clock is vulnerable to wearing magnetic characteristics. Therefore, by installing the antenna and the time correction mechanism apart from each other, the magnetic field from the time correction mechanism does not affect the antenna, and the receiving sensitivity of the antenna can be improved. Further, since the penetration of the magnetic field from the outside of the clock body can be prevented by the time correction mechanism, the mal-functioning of the electromagnetic motor can be prevented.

Further, in the case that the power source is a secondary battery possibly chargeable or dischargeable, the magnetic field is generated from the battery by the change of the voltage when the battery is charged or discharged. Since the direction of the magnetic field is on the same plane as the antenna core, they easily interfere with each other. Therefore, by installing the power source and the antenna apart from each other, for example, by installing the electromagnetic motor in the space formed by the separated installation as above, the impact of the magnetic field from the power source on the antenna can be prevented and the receiving sensitivity of the antenna can be improved.

The component of the time correction mechanism such as the winding stem are preferably in the same potential as the positive potential of the power source. By such a structure, even when the IC overlaps the time correction device, the electrostatic noise for the IC can be suppressed.

Here, the wheel train, the electromagnetic motor, the antenna, and the battery are preferably placed on the same plane. Further, the electromagnetic motor, the crystal oscillator, the antenna and the power source are preferably placed on the same plane. By such a structure, the components do not overlap between themselves, and thin-flatness can be made on the whole.

The electronic timepiece of the present invention includes a circuit substrate having conduction patterns on the both ends.

The surface of the antenna separated from the base frame and the surface of the power source separated from the base frame are placed on the opposite sides with the circuit substrate between them, and the circuit substrate is pressed-fit toward the base frame, and there is preferably provided a circuit pressing-plate, being composed of ferromagnetic member. Further, the circuit substrate is preferably possibly curved and bendable.

By such a structure, the magnetic field from the power source does not affect the antenna by the circuit pressing plate, being composed of ferromagnetic material, and the receiving sensitivity of the antenna can be improved. Since the impact of the magnetic field from the power source can be shielded by the circuit pressing-plate, the power source and the antenna can be installed close to each other. As a result, the clock can be minimized as a whole.

Further, the projection image projecting the circuit pressing-plate in the viewing direction of the time display surface is preferably separated from the projection images projecting the core of the antenna and the coil of the electromagnetic motor in the viewing direction of the time-display surface.

By such a structure, the antenna coil and the coil of the electromagnetic motor can be wound thick without the obstruction to the circuit pressing-plate. Then, the number of ampere turns is increased, and the receiving sensitivity of the antenna can be improved. Further, the antimagnetic performance of the electromagnetic motor can be improved. Further, if the circuit pressing-plate is the same potential as the positive potential of the power source, since the circuit substrate is covered with the circuit pressing-plate, the light from the outside or the electrostatic noise is shielded by the circuit pressing-plate, and does not affect the operation of the time-measuring control circuit or reception processing circuit so as to prevent the malfunctioning.

In the electronic timepiece of the present invention, the radio waves are standard radio waves including a time code, and the electronic timepiece is preferably a radio wave correction clock receiving the standard radio waves and correcting the time of the time-measuring mechanism.

By such a structure, the time code of radio waves is received by the receiving mechanism, and time of the time-measuring mechanism is corrected based on the received time code. Then, if, for example, long wave standard radio waves are used as time information, it can be a radio wave correction clock automatically correcting time exactly.

By providing a band for wristwatch, being composed of a conductive material, the projection images of the receiving antenna and the band for wrist clock projecting in the time viewing direction are preferably separated from each other. By such a structure, since the receiving antenna and the band for wrist clock do not overlap, wireless radio waves interlinked with the receiving antenna can be ensured, and the receiving sensitivity of the receiving antenna can be maintained high. If the band for wrist clock is composed of a conductive material, wireless radio waves can be drawn into the band for wrist clock, but if the band for wrist clock and the receiving antenna do not overlap, even though wireless radio waves can be drawn into the band for wrist clock, the impact of the interlink magnetic flux on the receiving antenna is decreased.

An electronic timepiece of the present invention may preferably include a generating mechanism having a generator, a time-measuring mechanism for measuring time, and a receiving mechanism having an antenna for receiving wireless information, and magnetic field shielding, means is installed between the antenna and the generating coil of the generator, for shielding the antenna from the magnetic field generated by the generating coil.

By such a structure, the time-measuring mechanism or the receiving mechanism is driven by the electrical energy by the generator of the generating mechanism. The wireless information is received by the antenna, and if the wireless information is, for example, standard radio waves including time information, time of the time-measuring mechanism is corrected based on the time information.

Since the magnetic field shielding means is installed between the antenna and the generating coil, it is difficult for the magnetic field (normally it indicates the space which magnetic force reaches, but in this specification, it has the almost same meaning as magnetism) generated in the generator to overlap the antenna. If the magnetic field from the generating coil is shielded and does not reach the antenna, when wireless information is received by the antenna, the signals of wireless information is not distorted by the magnetic field from the generating coil. Therefore, wireless information can be received by the antenna surely. Further, if the magnetic field from the generating coil on the antenna is a little, even though the receiving sensitivity of the antenna is increased, the antenna does not receive the noise of the magnetic field from the generating coil, and receives only wireless information. This is a big advantage in the case of receiving relatively weak wireless information such as standard radio waves.

The generator includes, for example, coils for converting mechanical energy by a rotary weight or the winding stem, etc. to electrical energy, and also coils (transformation coils) used in the case of transforming an alternating current from a normal power source and charging. Or, the coils of a stepping motor can be used.

In the electronic timepiece of the present invention, the magnetic field shielding means preferably includes at least one magnetic field shielding member, being composed of a ferromagnetic material, installed along the antenna.

By such a structure, the magnetic field generated in the generating coil can be drawn into the magnetic field shielding member, being composed of a ferromagnetic member, before reaching the antenna, and the loop formed by passing through the magnetic field shielding member and coming back to the generating coil can be easily made. That is, since the magnetic field from the generating coil bypasses the magnetic field shielding member, it is shielded before reaching the antenna. Therefore, the magnetic flux of the magnetic field passing through the antenna can be decreased.

The magnetic field shielding member, being composed of these ferromagnetic materials is formed of, for example, steel, nickel, cobalt, or these alloys.

The electronic timepiece of the present invention preferably includes a stepping motor for driving the hands indicating time, and the magnetic field shielding member of the magnetic field shielding means preferably includes the coil core of the stepping motor.

The electronic timepiece of the present invention preferably includes a secondary battery for storing the power generated in the power-generation mechanism, and the magnetic field shielding member of the magnetic field shielding means preferably includes the case of the secondary battery.

As the magnetic field shielding member, a new additional member for shielding magnetic field can be installed, but if using the components included in the normal electronic timepiece and being composed of a ferromagnetic material, since the number of components is not increased, the space saving or the reduction for components cost can be facilitated, and also, the decrease of productivity can be prevented.

Further, the stepping motor or the secondary battery does not affect the driving of the motor or the storage of the secondary battery even though magnetic field flows the coil core, or the case, which does not bring any problem.

Here, the magnetic field shielding means can include one or more stepping motors only, or one or more secondary batteries only, or one or more stepping motors and one or more secondary batteries.

In the case that two or more magnetic field shielding-members such as the stepping motor or the secondary battery are installed, these magnetic field shielding members are preferably installed along the antenna to the generating coil of the antenna.

An electronic timepiece of the present invention is characterized in that the central axis of the antenna and the central axis of the generating coil of the generator cross at an angle ranging from 60° to 120° when projecting the antenna on the plane surface including the generating coil. Particularly, each central axis of the antenna and the generating coil is preferably crossed at an angle of about 90°.

An electronic timepiece of the present invention is preferably configured such that the central axis of the antenna crosses the plane face including the central axis of the generating coil of the generator at an angle ranging from 60° to 120°. Particularly, the crossing angle is preferably about 90°.

By such a structure, the impact of the magnetic field generated from the generating coil on the antenna can be decreased. Therefore, the erroneous reception in the antenna by the magnetic field can be decreased. That is, if each central axis of the antenna and the generating coil is crossed in the range of 90°±30° on the projection surface, or the central axis of the antenna crosses the plane face including the central axis of the generating coil in the range of 90°±30°, since the antenna does not follow the line of the magnetic flux from the generating coil, it is difficult for the magnetic field from the generating coil to interfere with the antenna, and the erroneous reception in the antenna can be prevented.

An electronic timepiece of the present invention preferably includes hands to display time, and is preferably configured such that the antenna and the generating coil are installed on the opposite sides to each other with the hand axis of the hands between them.

To prevent the magnetic field from the generating coil from affecting the antenna, the generating coil and the antenna are preferably installed apart from each other as possible as they are. Therefore, if the generating coil and the antenna are installed on the opposite sides to each other with the hand axis of the hands to display time between them, the distance between the components can be extended. As a result, the magnetic field from the generating coil on the antenna can be decreased, and wireless information can be received by the antenna without the impact of the magnetic field.

In the electronic timepiece of the present invention, the wireless information is standard radio waves including a time code, and the electronic timepiece is preferably a radio wave correction clock receiving the standard radio waves and correcting the time of the time-measuring mechanism.

By such a structure, since the time code of wireless information is received by the receiving mechanism, and time of the time-measuring mechanism is corrected based on the received time code, if, for example, long wave standard radio waves are used as time information, it can be a radio wave clock being capable of automatically correcting time exactly. Particularly, since standard radio waves are relatively weak radio waves, in the case that the magnetic field generated from the generating coil overlaps the antenna, and the standard radio waves and the magnetic field interfere with each other, the receiving is hardly made, but according to the present invention, magnetic field shielding means is installed so as to make sure of the receiving.

An electronic apparatus of the present invention may include a generating mechanism having a generator, and a receiving mechanism having an antenna for receiving wireless information, and magnetic field shielding means is preferably installed between the antenna and the generating coil of the generator, for shielding the antenna from the magnetic field generated by the generating coil.

By such a structure, the electronic apparatus can be driven by the power from the generating mechanism. When wireless information is received by the antenna, if, for example, the wireless information includes time information, time is displayed based on the time information, and if the wireless information is news, the news is displayed.

Since the magnetic field shielding means is installed between the antenna and the generating coil, the magnetic field (the line of magnetic force) generated in the power generation by the generator hardly overlaps the antenna. Since the magnetic field from the generating coil is shielded and does not reach the antenna, when the wireless information is received by the antenna, the signals of the wireless information is not distorted by the magnetic field from the generating coil. Therefore, the wireless information can be surely received by the antenna. Further, if the magnetic field flowing into the antenna from the generating coil is a little, even though the receiving sensitivity of the antenna is increased, the antenna does not receive the noise of the magnetic field from the generating coil, and can receive only wireless information. This is a big advantage in receiving wireless information which is relatively weak such as standard radio waves.

As such, the wireless information is not limited to time information and news, and may include, for example, various information such as weather reports, time schedules of subways, etc.

BEST MODE FOR CARRYING OUT THE INVENTION

Now, the present invention will be further illustrated with examples below.

EXAMPLE 1

Figure 1:
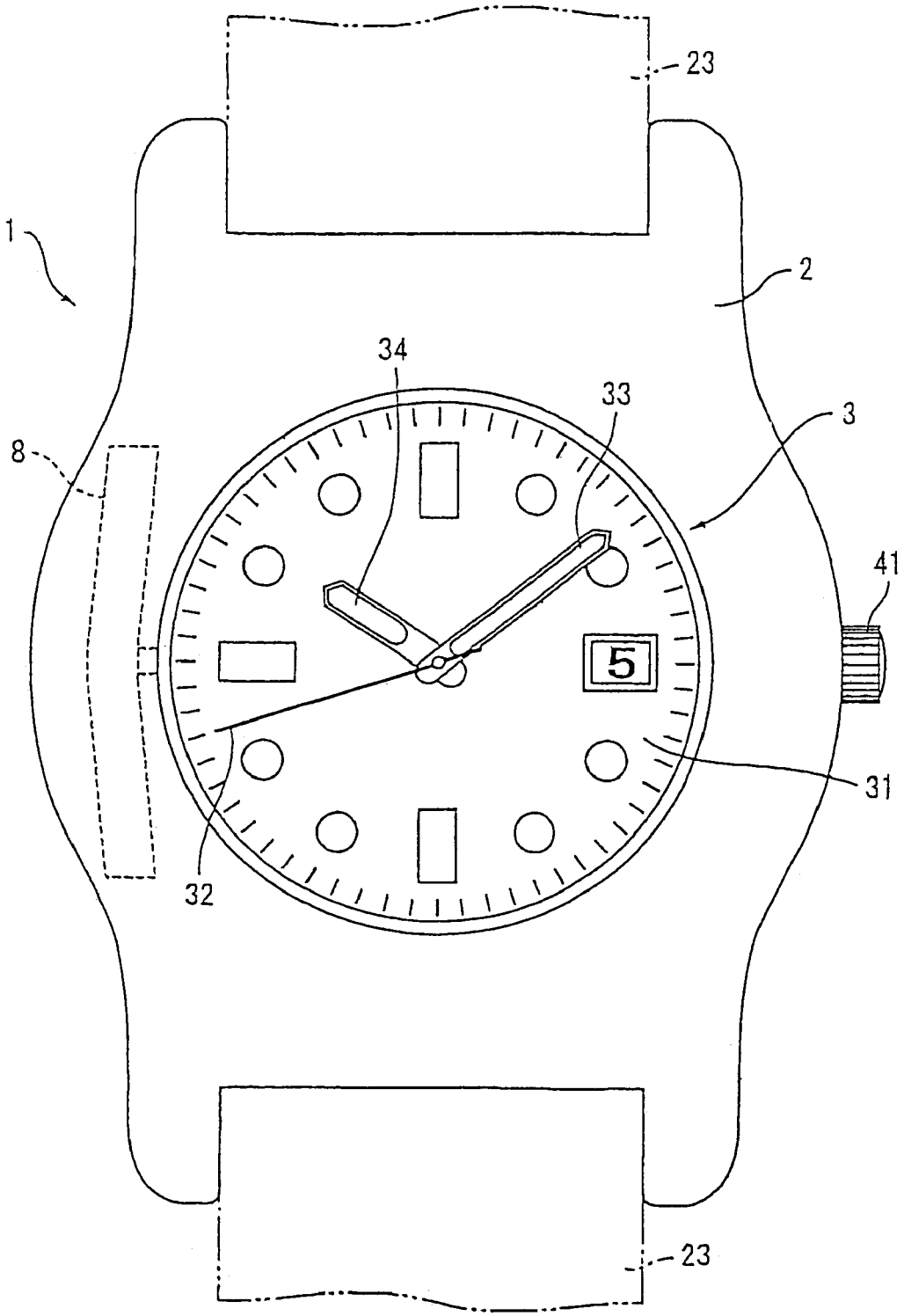
FIG. 1 is an outer view of a radio wave clock according to a first embodiment of the present invention.
Figure 2:
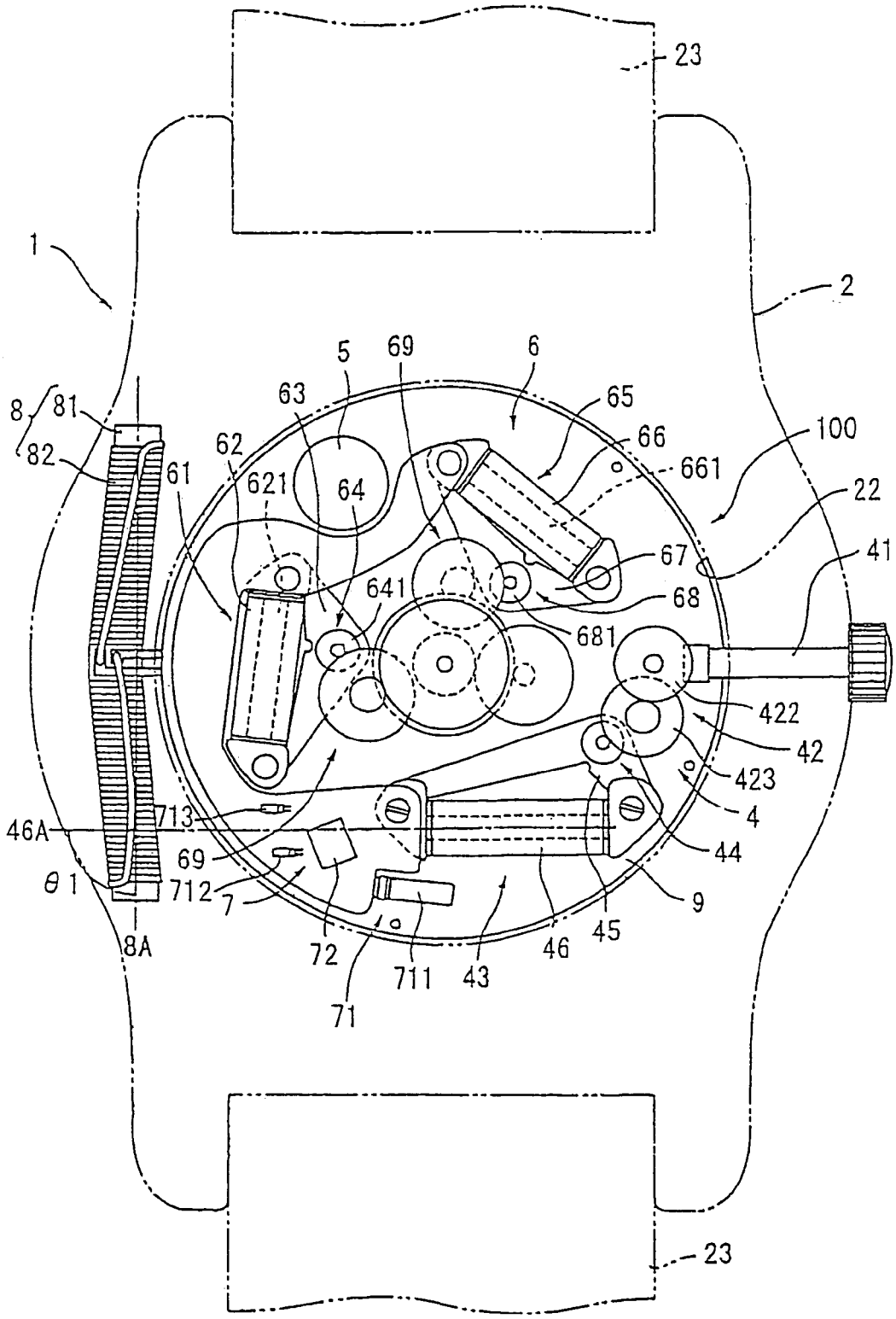
FIG. 2 is a view of the internal structure of the first embodiment with a back lid removed off.

FIG. 1 is an outer view of a wristwatch-typed radio wave clock 1 according to the electronic timepiece and electronic apparatus of a first embodiment of the present invention. FIG. 2 is a view of the radio wave clock 1 with a back lid removed off.

The radio wave clock 1 includes a body case 2 as a base frame, a time-measuring movement 100 installed inside the body case 2, and an antenna 8 for receiving standard radio waves including time information as wireless information (radio-waves).

The body case 2 is substantially ring-shaped and composed of a non-conductive material such as synthetic resin or ceramic, etc., and of a diamagnetic material such as brass or gold alloy, etc., and there is a time display part 3 installed on the external surface of the body case 2, which is shown in FIG. 1. Attachment portions are provided respectively on the peripheral two opposite locations of the body case 2, for attaching a wristwatch band 23.

The time display part 3 includes a dial 31 substatially circular in shape and attached inside the ring of body case 2, and hands for displaying time, that is, a second hand 32, a minute hand 33, and an hour hand 34. There is formed a substantially circular-shaped concave portion 22 on the back side of the substantially circular-shaped dial 31 by the internal wall of the body case 2, and a movement 100 is installed on the concave portion 22.

The time-measuring movement 100 includes a power-generation mechanism 4 as a generating mechanism, a secondary battery 5 for storing the power generated by the power-generation mechanism 4, a driving portion 6 driven by the secondary battery 5 as a power-source, a circuit block 7 having a crystal oscillator 71 and an IC 72 for control installed thereon, a base plate 9 interposing and integrating these, and a wheel train bridge 691.

The power-generation mechanism 4 includes a winding stem 41 of a crown, one end of which is provided outside the body case 2, the other end of which is provided inside the body case 2, and the axis of which is rotatably installed, a power transmission part 42 for transmitting the mechanical energy by the rotation of the winding stem 41 through gear wheel train, and a generator 43 generated by the power transmitted by the power transmission part 42.

The generator 43 is a typical generator including a power-generation rotor 44 rotated by the power transmitted by the power transmission part 42, a power-generation stator 45, and a coil for power generation (power-generation coil) 46.

Figure 3:
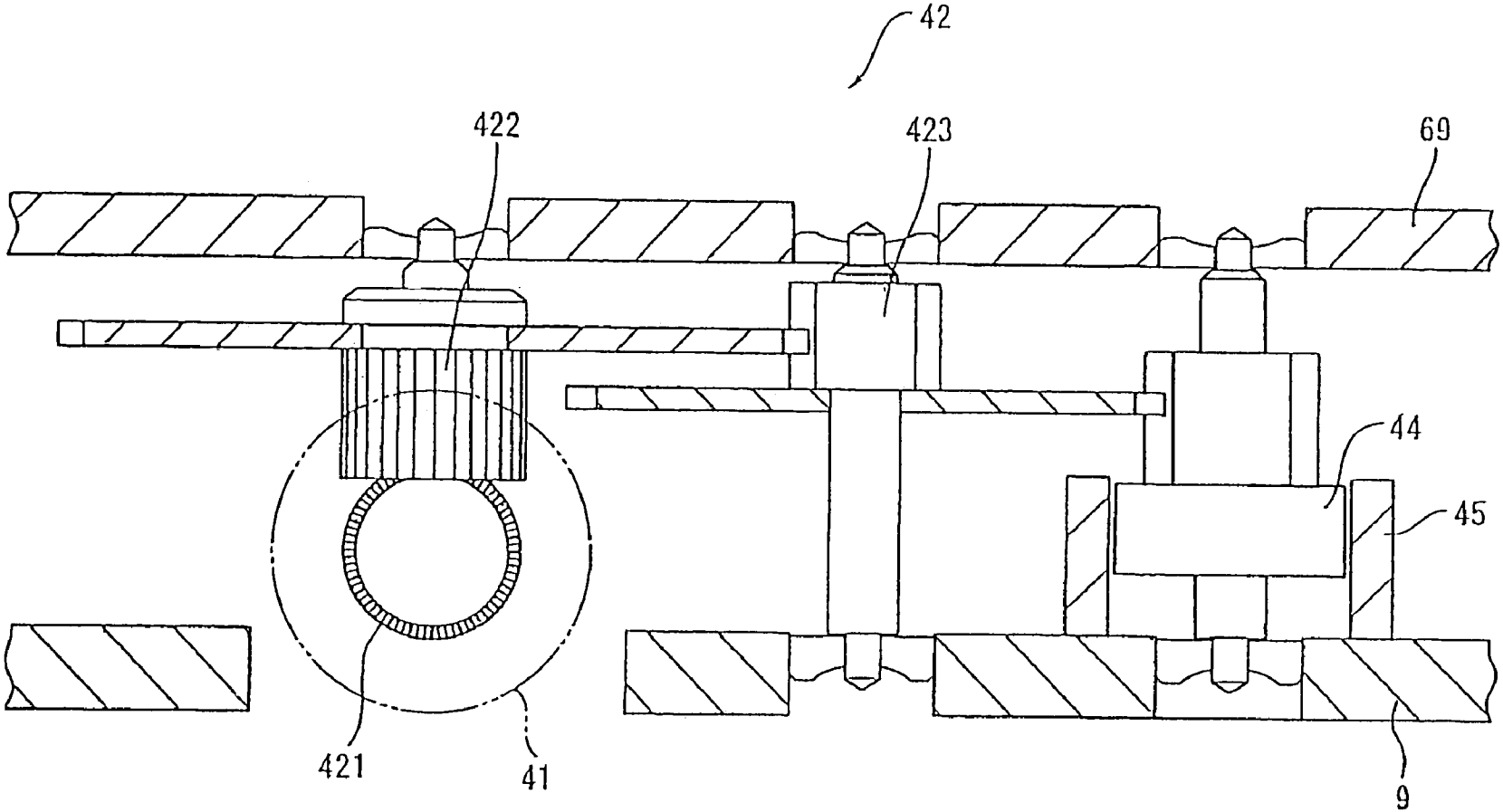
FIG. 3 is an expanded cross-sectional view of a power transmission part of the first embodiment.

The power transmission part 42, as shown in a cross-sectional view of FIG. 3, is configured to be connected to the power-generation rotor 44 through a crown gear 422 and an intermediate gear 423, which are sequentially engaged with a clutch wheel 421 installed in the other end of the winding stem 41.

The winding stem 41 can be used to match time and to input the mechanical energy as the mechanical energy input mechanism.

The secondary battery 5 has a typically-known structure, and the case (outer can) of the secondary battery 5 is button-typed and composed of a ferromagnetic metallic material. For example, SUS304 (stainless steel) can be used as the ferromagnetic material to form the case of the secondary battery 5. As the secondary battery 5 can be used a solid electrolytic battery, which is liable to deformation such as bending and curvature. In the case of using the deformation-flexible secondary battery 5, it can be also used as a magnetic field shielding member by being disposed between the antenna 8 and the power-generation coil 46, and deforming in such a proper shape.

The driving portion 6 includes a second hand driving motor 61 (second electromagnetic motor, stepping motor) for driving a second hand 32 of the time display part 3, a minute/hour hand driving motor 65 (first electromagnetic motor, stepping motor) for driving a minute hand 33 and an hour hand 34, and a wheel train part 69 for transmitting the power of the second hand driving motor 61 and the minute/hour hand driving motor 65 to the second hand 32, the minute hand 33, and the hour hand 34 respectively.

The second hand driving motor 61 includes a coil for second hand motor 62 wound around a coil core 621, a stator for second hand motor 63 for transmitting the induced magnetic field from the coil for second hand motor 62, and a rotor for second hand motor 64 rotatably installed on the opening part of the stator for second hand motor 63, and rotating by the induced magnetic field. A rotor magnet 641 of the rotor 64 for second hand motor uses a rare-earth magnet having two or more poles attached, for example, samarium cobalt group is preferably used.

The minute/hour hand driving motor 65 basically has the same structure as the second hand driving motor 61, and includes a coil for minute/hour hand motor 66 wound around a coil core 661, a stator for minute/hour hand motor 67, and a rotor for minute/hour hand motor 68. A rotor magnet 681 of the rotor for minute/hour hand motor 68 uses a rare-earth magnet having two or more poles attached, for example, samarium cobalt group is preferably used. A coil core 621 of the second hand driving motor 61, a stator for second hand motor 63, a coil core 661 of the minute/hour hand driving motor 65, and a stator for minute/hour hand motor 67 are composed of a member of high magnetic permeability such as permalloy material.

The wheel train part 69 is engaged with the rotor 64 for second hand motor and the rotor for minute/hour hand motor 68 respectively, and transmits each power to the second hand 32, the minute hand 33, and the hour hand 34.

The gear axis of the gear train such as the wheel train part 69 or the power transmission part 42 needs to hold a mechanical strength to facilitate the miniaturization of a clock or an electronic apparatus, and is normally composed of steel materials such as carbon steel or stainless steel.

The circuit block 7 includes a crystal oscillator 71 performing the oscillation for a predetermined period, or an IC 72 for control. As the crystal oscillator 71 are installed a time-measuring crystal oscillator 711 for oscillating a reference clock, and tuning-signal crystal oscillators 712, 713 for generating tuning signals tuned to the frequency of standard radio waves. The tuning-signal crystal oscillators are two, that is, a crystal oscillator 713 tuned to the standard radio waves of 60 kHz, and a crystal oscillator 712 tuned to the standard radio waves of 40 kHz, for example, in Japan. Further, crystal oscillators for 60 kHz and 77.5 kHz are used, for example, in Europe and America.

The IC 72 for control includes a dividing circuit for dividing the frequency from the crystal oscillator 711 and generating a reference clock, or a time-measuring circuit for counting a reference clock and measuring time, or a control circuit for controlling the motor (second hand driving motor 61, minute/hour hand driving motor 65) for the driving portion 6 based on the signal from the time-measuring circuit, or a receiving circuit for processing (amplification, demodulation, etc.) the time information received by the antenna 8. The IC 72 for control is possibly formed by commonly using the available circuit portions or by employing software from a computer, etc. besides analog circuits.

Here, there is provided a time-measuring mechanism being composed of the crystal oscillator 711, the dividing circuit and the time-measuring circuit.

The antenna 8 includes a core 81 composed of ferrite, and a receiving coil 82 formed by coils wound around the core 81. The core 81 of the antenna 8 may be composed of ferrite, amorphous metal, SUY (electromagnetic soft steel), etc. For example, in the case of forming the core 81 of the antenna 8 of electromagnetic soft steel, there is an advantage that a curved-shape can be made along the shape of the body case 2.

The time information (wireless information) received by the antenna 8 is output to the receiving circuit of the IC 72 for signal processing. Therefore, a receiving mechanism is composed of the antenna 8 and the receiving circuit of the IC 72.

Further, for the time information received by the antenna 8, for example, a long wave standard radio wave (JJY), etc. can be used.

Now, the configuration layout of the radio wave clock 1 will be explained.

In the planar view of the radio wave clock 1 in the direction of its back lid as shown in FIG. 2, the antenna 8 is placed such that the central axis 8A of the antenna 8, that is, the central axis of the core 81 crosses the extended line of the central axis 46A of the power-generation coil 46 at an angle θ1 of about 90°.

In the planar placement, the-second hand driving motor 61 is placed between the antenna 8 and the power-generation coil 46. The coil core 621 of the second hand driving motor 61 functions as a magnetic field shielding member, and forms magnetic field shielding means.

In this embodiment, the antenna 8 is installed in the direction of 9 o'clock. Since the winding stem 41 of the crown as an external manipulation member is often installed in the direction of 3 o'clock, it is preferable to place the antenna 8 not to overlap the winding stem 41, etc. in the direction besides 3 o'clock, which contributes to the thin-film. Further, it is possible to place the antenna 8 in the direction of 6 o'clock and 12 o'clock. However, in the case that the band for arm-wearing is composed of a conductive material such as a metal, etc., the interlink magnetic flux generated in the coil 82 of the antenna 8 easily overlaps the band. As a result, there is a possibility of reducing the receiving sensitivity of the antenna 8. Therefore, in the case of using a conductive band of a metal, etc., the antenna 8 is preferably placed in the direction of 9 o'clock to maintain the receiving sensitivity of the antenna 8 good. Further, in the case of using a non-conductive band of a synthetic resin, etc., the antenna 8 can be installed in any direction of 6, 9, and 12 o'clock.

In this embodiment, the magnetic field shielding means mainly includes the coil core 621 of the second hand driving motor 61, and may also include a metallic component of the gear of the wheel train part 69 placed between the antenna 8 and the power-generation coil 46.

Further, the placement of the magnetic field shielding member (magnetic field shielding means) between the antenna 8 and the power-generation coil 46, means that the magnetic field generated in the power-generation coil 46 is shorter in the magnetic circuit closed through the magnetic field shielding member than in the magnetic circuit closed through the antenna 8. That is, the distances between the two ends of the magnetic field shielding means, being composed of the coil for second hand motor 62, and the two ends of the power-generation coil 46 is shorter than the distances between two ends of the power-generation coil 46 and the two ends of the antenna 8.

In this embodiment, the antenna 8, the generator 47, the second hand driving motor 61, the minute/hour hand driving motor 65, and the secondary battery 5 are placed on the same plane. That is, since these are placed on the same surface as the body case 2 which is a base frame, they are placed not to overlap in the thickness direction of the radio wave clock 1. In such a placement, since the thickness measurement of the radio wave clock 1 is made thin, the installation or the design characteristics can be improved.

In such structure, the winding stem 41 is rotated by the manipulation of winding by a human hand. Then, the mechanical energy by the rotation of the winding stem 41 is transmitted through the gear train (clutch wheel 421, crown gear 422, intermediate gear 423) of the power transmission part 42 to the power-generation rotor 44, and the power-generation rotor 44 is rotated. When the power-generation rotor 44 is rotated, the change of the magnetic field occurs in the power-generation stator 45, and an induced current is generated in the power-generation coil 46 by the change of the magnetic field. The induced current is stored in the secondary battery 5. The crystal oscillator 71 or the IC 72, the second hand driving motor 61, and the minute/hour hand driving motor 65 are driven by the stored power.

When voltage is applied on the crystal oscillator 71, the output oscillating signal is divided on the dividing circuit on the IC 72 so as to generate a standard signal. At the same time of the time measuring in the time-measuring circuit on the IC 72 based on the standard signal, the second hand driving motor 61 and the minute/hour hand driving motor 65 are driven, and then, the rotor 64 for second hand motor and the rotor 68 for minute/hour hand motor are rotated. The rotation of the rotor 64 for second hand motor and the rotor 68 for minute/hour hand motor is transmitted to the hands (second hand 32, minute hand 33, hour hand 34) by the wheel train part 69 so as to display time.

If time information is received by the antenna 8, the time clocked by the time-measuring circuit on the IC 72 can be corrected based on the time information, and the corrected time is displayed by the hands.

By such a structure, the effects can be achieved as follows according to the first embodiment.

(1) Since the magnetic field shielding member such as the second hand driving motor 61 is installed between the antenna 8 and the power-generation coil 46, the magnetic flux of the magnetic field generated from the power-generation coil 46 can easily form a closed loop formed by passing through the second hand driving motor 61, etc. before reaching the antenna 8, and coming back to the power-generation coil 46. Particularly, since the coil core 621 and the stator for second hand motor 63 are composed of a high magnetic permeability of a member such as permalloy material, the magnetic flux of the magnetic field flows much through the medium of the high magnetic permeability so as to increase the effects of shielding magnetic field. Therefore, since the magnetic field from the power-generation coil 46 hardly reaches the antenna 8, the impact of the magnetic field from the power-generation coil 46 on the antenna 8 can be decreased, and the receiving sensitivity of the antenna 8 can be improved much more than ever. Further, the magnetic field from the power-generation coil 46 can be also shielded not to reach the antenna 8 by the steel material such as the wheel train part 69, and therefore, the wheel train part 69 can be also used as the magnetic field shielding member.

The magnetic field shielding member functions as a component of the radio wave clock 1, it is therefore not necessary to install additional new components for magnetic field shielding, and since it is only required to adjust the planar layout of the antenna 8, the secondary battery 5, the second hand driving motor 62, the minute/hour hand driving motor 65, and the power-generation coil 46, the cost increase due to the increase of the number of components, or the decrease of productivity can be prevented.

(2) Since it is difficult for the magnetic field from the power-generation coil 46 to reach the antenna 8 by the magnetic field shielding member, the magnetostriction of the core 81 of the antenna 8 can be suppressed. Therefore, the progression of the internal destruction of the antenna 8 by the magnetostriction can be suppressed, and the life time of the antenna 8 can be lengthened.

Since the expansion and contraction of the core 81 generated by the magnetostriction can be suppressed, the friction of the electrically-insulating coating film and the core 81, being generated in a surface of the receiving coil 82 can be prevented. Therefore, the electrically-insulating state between the receiving coil 82 and the core 81 can be long maintained.

(3) The antenna 8 is placed such that the central axis 8A of the core 81 of the antenna 8 crosses the extended line of the central axis 46A of the power-generation coil 46 at an angle θ1 of about 90°. Therefore, while time information is received by the antenna 8, even if the magnetic field is generated from the power-generation coil 46 by the rotation of the winding stem 41, since the magnetic flux of the magnetic field and the coil 82 of the antenna 8 are directed straight, the magnetic flux of the magnetic field hardly overlap with the antenna 8. As a result, since the impact of the magnetic field from the power-generation coil 46 for antenna 8 can be decreased, the erroneous reception is possibly removed, and the receiving sensitivity of the antenna 8 can be improved.

(4) Since the core 81 is composed of ferromagnetic material, that is, ferrite, the magnetic field penetrating from the outside to the radio wave clock 1 is converged in the core 81. Therefore, the magnetic field from the outside of the radio wave clock 1 is prevented from penetrating inside the magnetic circuit of the stepping motor such as the second hand driving motor 61, and the second hand driving motor 61 can be prevented from malfunctioning by the external magnetic field.

EXAMPLE 2

Figure 4:
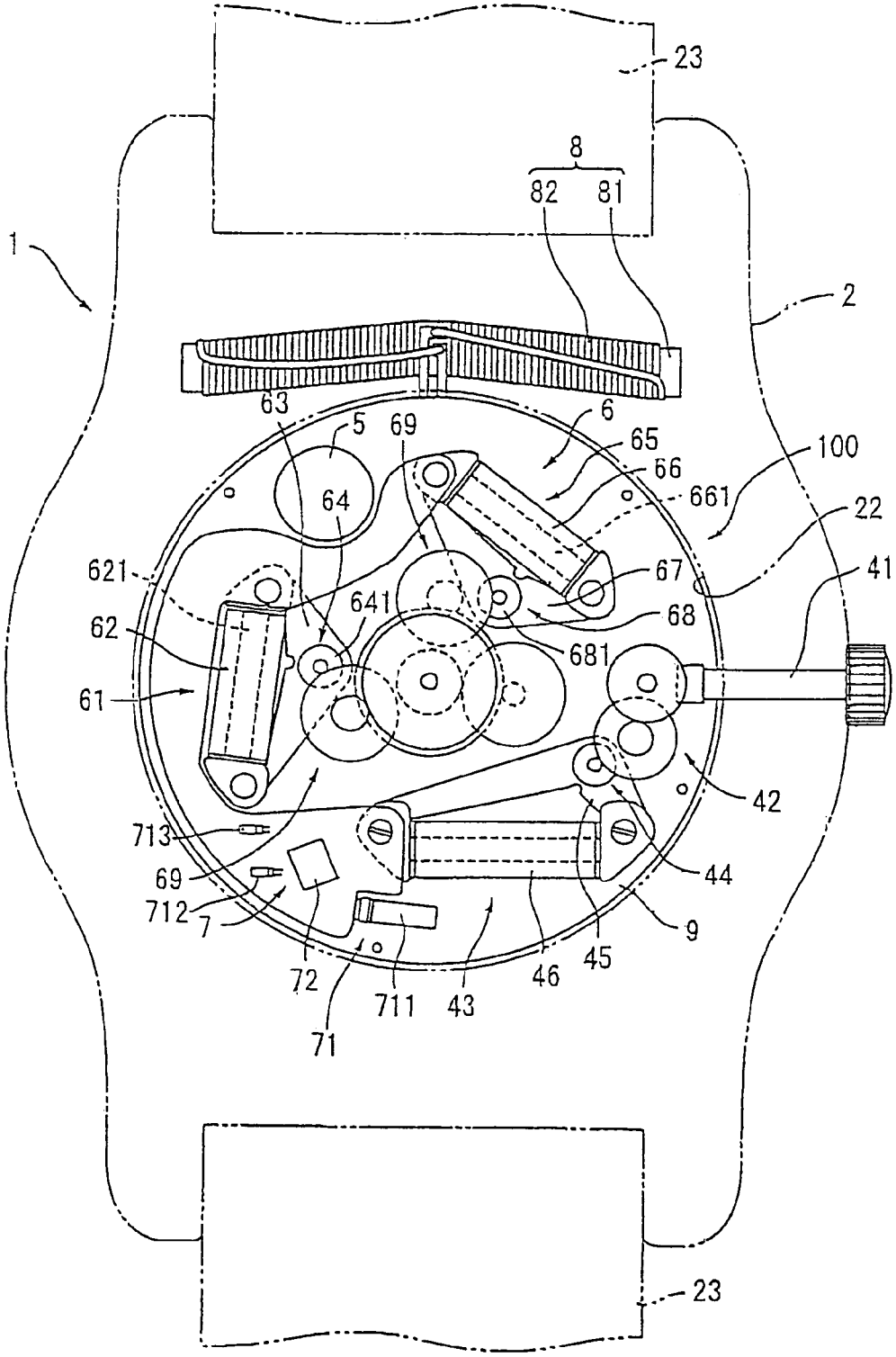
FIG. 4 is a view of the internal structure of a radio wave clock with a back lid removed off according to a second embodiment of the present invention.

FIG. 4 illustrates a radio wave clock 1 of the electronic timepiece according to the second embodiment of the present invention. The basic structure of the radio wave clock 1 is the same as that of the first embodiment, and the placement of the antenna 8 and the coil 46 is different from the structure in the first embodiment. In this embodiment, the antenna 8 and the generating coil 46 are placed on the opposite side with a hand axis 35 of the hands (a second hand 32, a minute hand 33, and an hour hand 34) between them, and they are placed furthest apart from each other in the structure of the radio wave clock 1.

A secondary battery 5, a second hand driving motor 61, and a minute/hour hand driving motor 65 are placed between the antenna 8 and the power-generation coil 46. Therefore, magnetic field shielding means includes a coil core 621 of a coil for second hand motor 62, a coil core 661 of a coil for minute/hour hand motor, and the case of the secondary battery 5. The magnetic field shielding means is mainly composed of the coil core 621 of a coil for second hand motor 62, the coil core 661 of a coil for minute/hour hand motor, and the case of the secondary battery 5, but the metallic components of the gear train such as the wheel train part 69 or the power transmission part 42 arranged between the antenna 8 and the power-generation coil 46 can be included in the magnetic field shielding means. Because of this, the magnetic circuit of the magnetic field generated from the power-generation coil 46 is configured not to pass through the antenna 8 and to be closed through the coil core.621 of the coil for second hand motor 62, the coil core 661 of the coil for minute/hour hand motor, the secondary battery 5, and the gear train.

Further, even though the secondary battery 5 is placed adjacent to the antenna 8, the secondary battery 5 is placed adjacent to the longitudinal sides of the antenna 8 not to the ends of the antenna 8. In the case of placing the secondary battery 5 adjacent to the longitudinal sides of the antenna 8, it is preferable to place to the central part of the antenna 8. The placement of the secondary battery 5 to the central part of the antenna 8 can reduce the impact of the interlink magnetic flux on the antenna 8.

By such a structure, as follows can be achieved the effects similar further to the effects (1), (2), and (4) of the first embodiment.

(5) Since the antenna 8 and the power-generation coil 46 are placed to the opposite sides with the hand axis of the hands (second hand 32, minute hand 33, hour hand 34) between them, furthest apart from each other in the structure, the magnetic field generated from the power-generation coil 46 hardly reach the antenna 8. Because of this, during the reception by the antenna 8, the impact of the magnetic field from the power-generation coil 46 hardly reaches so as to suppress the erroneous reception.

(6) Since two motors (second hand driving motor 61, minute/hour hand driving motor 65) and the secondary battery 5 are placed between the antenna 8 and the power-generation coil 46, the total length of the magnetic field shielding means can be more lengthened than in the above embodiment, and the magnetic flux of the magnetic field generated from the power-generation coil 46 can easily form a closed loop formed by passing through the second hand driving motor 61, the minute/hour hand driving motor 65, and the secondary battery 5, and coming back to the power-generation coil 46. Therefore, the magnetic field shielding effects can be improved by the magnetic field shielding means, and the impact of the magnetic field from the power-generation coil 46 on the antenna 8 can be much more decreased.

EXAMPLE 3

Figure 5:
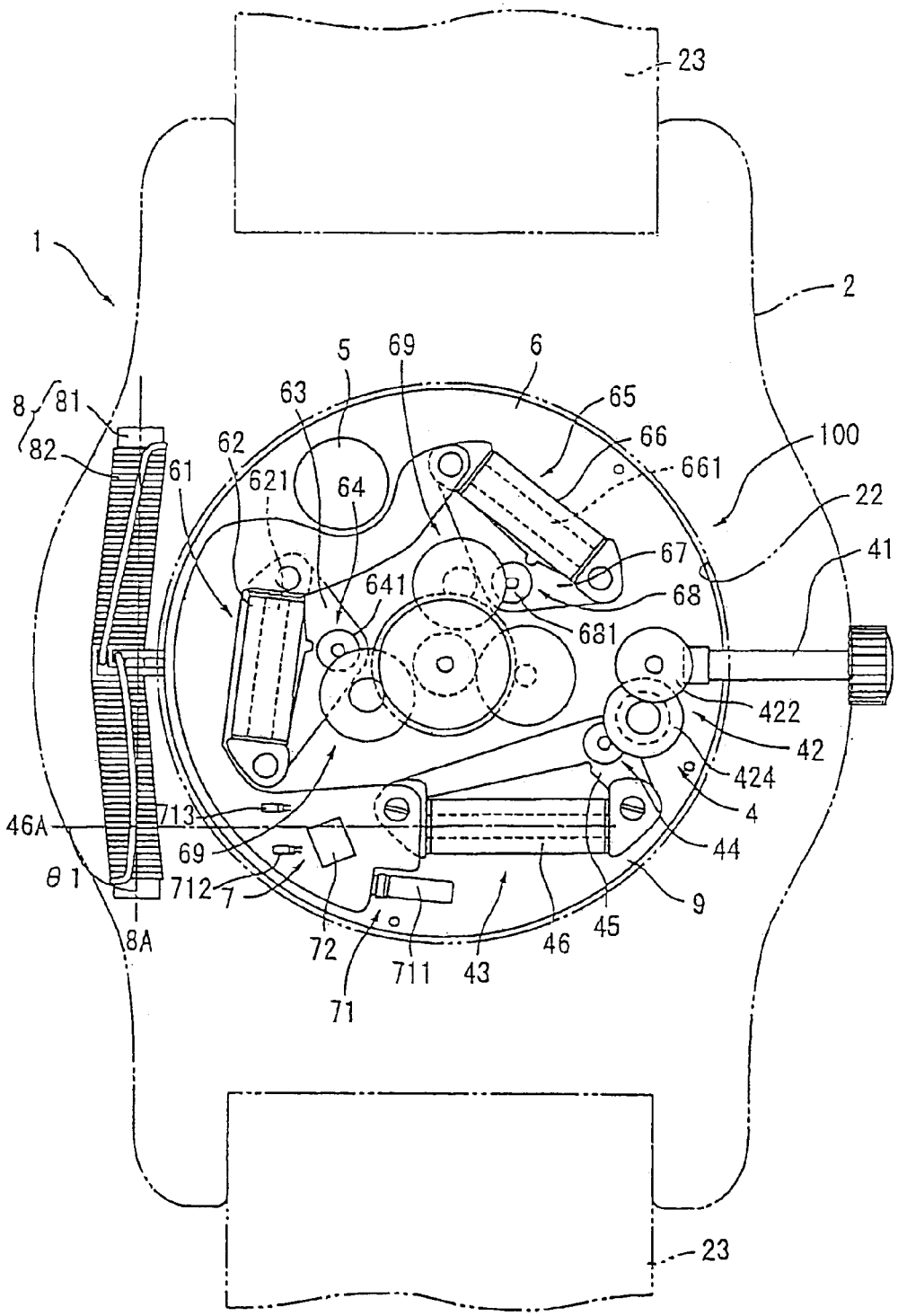
FIG. 5 is a view of the internal structure of a radio wave clock with a back lid removed off according to a third embodiment of the present invention.

FIG. 5 illustrates a radio wave clock 1 of the electronic timepiece according to the third embodiment of the present invention. The basic structure of the radio wave clock 1 is the same as that of the first embodiment. The structure of an intermediate gear of a power transmission part 42 of the third embodiment is different from that of the first embodiment.

Figure 6:
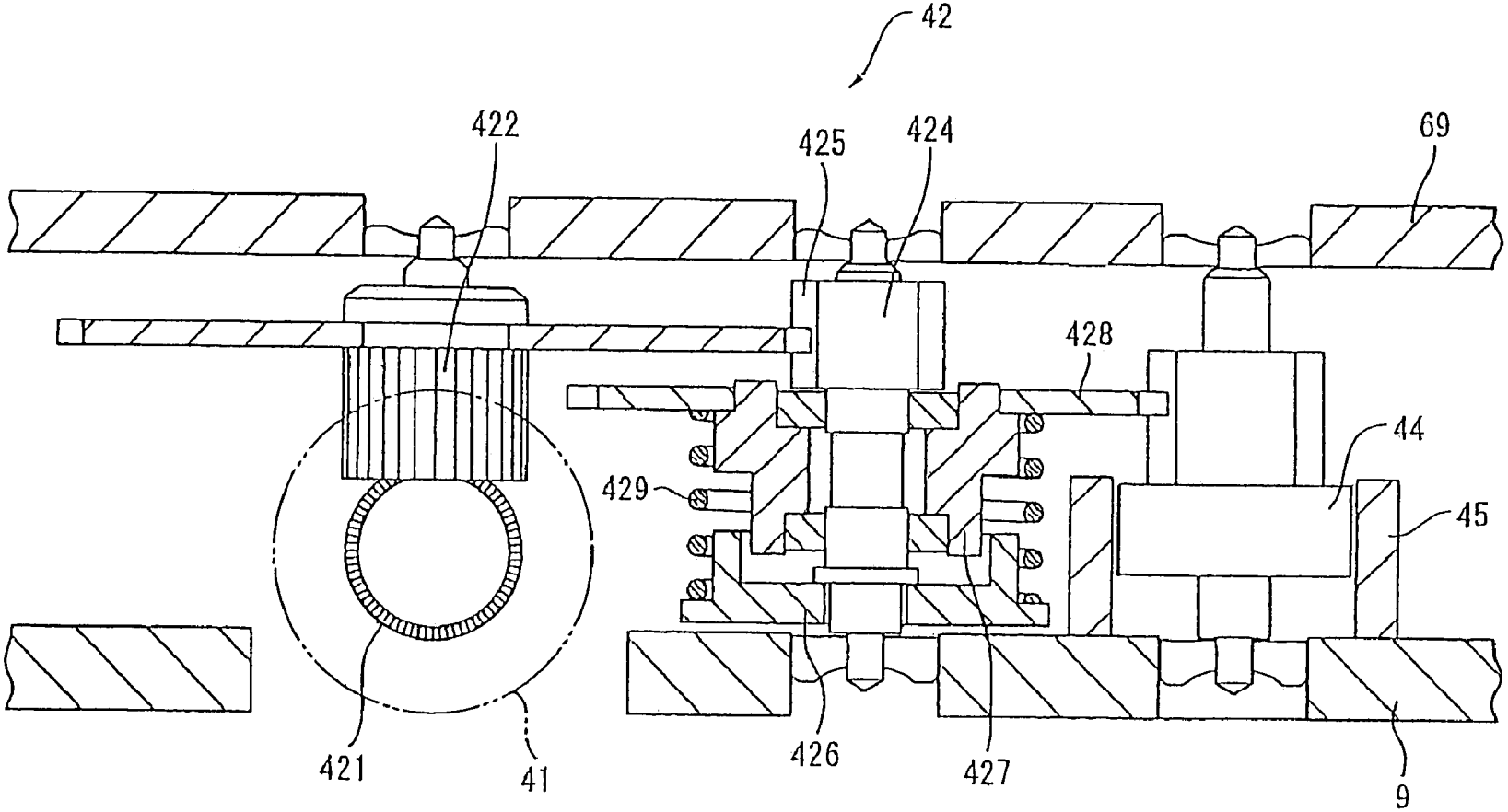
FIG. 6 is an expanded cross-sectional view of a power transmission part of the third embodiment.

FIG. 6 illustrates an intermediate gear 424 in this embodiment. The intermediate gear 424 is configured to include a first driving disk 425 engaged with a crown gear 422 and pressed-fit to the rotation axis, a first cylinder 426 pressed-fit to the rotation axis, a second cylinder 427 flexibly coupled to the rotation axis to rotate independently, a second driving disk 428 engaged with a power-generation rotor 44 and rotating integrally with the second cylinder 427, and a coil spring 429, the one end being fixed to the first cylinder and the other end being fixed to the second cylinder. Further, between the power-generation rotor 44 and a power-generation stator 45 are there installed location determination means for fixing the rotation of the power-generation rotor 44 until a torque above a predetermined level is applied on the power-generation rotor 44. The location determination means employs the means for magnetically binding the rotation of the power-generation rotor 44, such as, for example, a magnetic saturation part installed in a stator opening part of the power-generation stator 45.

Since the power-generation rotor 44 is bound up to a predetermined torque, namely, the second driving disk 428 and the second cylinder 427 are also bound up to a predetermined torque in the case of rotation.

Besides these, the placement of the antenna 8 and the power-generation coil 46, and the magnetic field shielding member, etc. are the same as those in the first embodiment.

In such structure, the winding stem 41 is rotated. Then, the rotation of the winding stem 41 is transmitted to the first driving disk 425 through a clutch wheel 421, and the rotation axis is rotated with the first driving disk 425. Along with the rotation axis, the first cylinder 426 is rotated, but the rotation power is stored in the coil spring 429. If the rotation power stored in the coil spring 429 exceeds a predetermined torque, the second driving disk 428 is rotated with the second cylinder 427. By the second driving disk 428, the power-generation rotor 44 is-rotated and power is generated.

According to the third embodiment as above, following effects can be achieved in addition to the effects similar further to the effects (1), (2), (3), and (4) of the first embodiment.

(7) By an intermediate gear 424, since a power-generation rotor 44 is-rotated by a torque above a predetermined level, the wave form of a power generation voltage can be made uniform and the power generation noise can be suppressed below a predetermined frequency. Therefore, a rectification means such as a band pass filter can be simplified. In addition, even when the winding stem 41 is rotated gradually, since the energy stored in a coil spring 429 is released fast, the power-generation rotor 44 is rotated at a high speed. Therefore, the power generation efficiency can be improved.

(8) Since the power generation is suppressed until a predetermined level of torque is stored in the coil spring 429, and the power generation occurs after the storage of a predetermined level of torque, the power generation/non-power generation states are repeated.

If the power generation/non-power generation states are repeated, the magnetic field from the power-generation coil 46 is generated only in the power generation state, and therefore, the time for generating magnetic field is reduced by the generator having the coil spring 429 compared with an always power generation typed generator. Therefore, since the magnetic field affecting the antenna 8 can be decreased, if the magnetic field shield is performed even by the magnetic field shielding member, the impact of the magnetic field on the antenna 8 can be much more suppressed.

Further, even when the antenna 8 and the power-generation coil 46 are closely installed, if receiving wireless signals in the non-power generation state, the erroneous reception can be prevented. In this case, since the wave forms of generating voltage are uniform, it is easy to recognize the power generation state on the electronic circuit.

(9) Since the power generation noise can be suppressed below a predetermined frequency by the coil spring 429, the magnetostriction of the core 81 can be suppressed. That is, for the core 81, since the maximum variation of the magnetostriction by the rapid change of magnetic field can be suppressed, the effects similar to the effect (2) of the first embodiment can be achieved. That is, since the internal destruction by the magnetostriction can be prevented, the electrically insulating state between the core 81 and the receiving coil 82 can be maintained for long.

EXAMPLE 4

Figure 7:
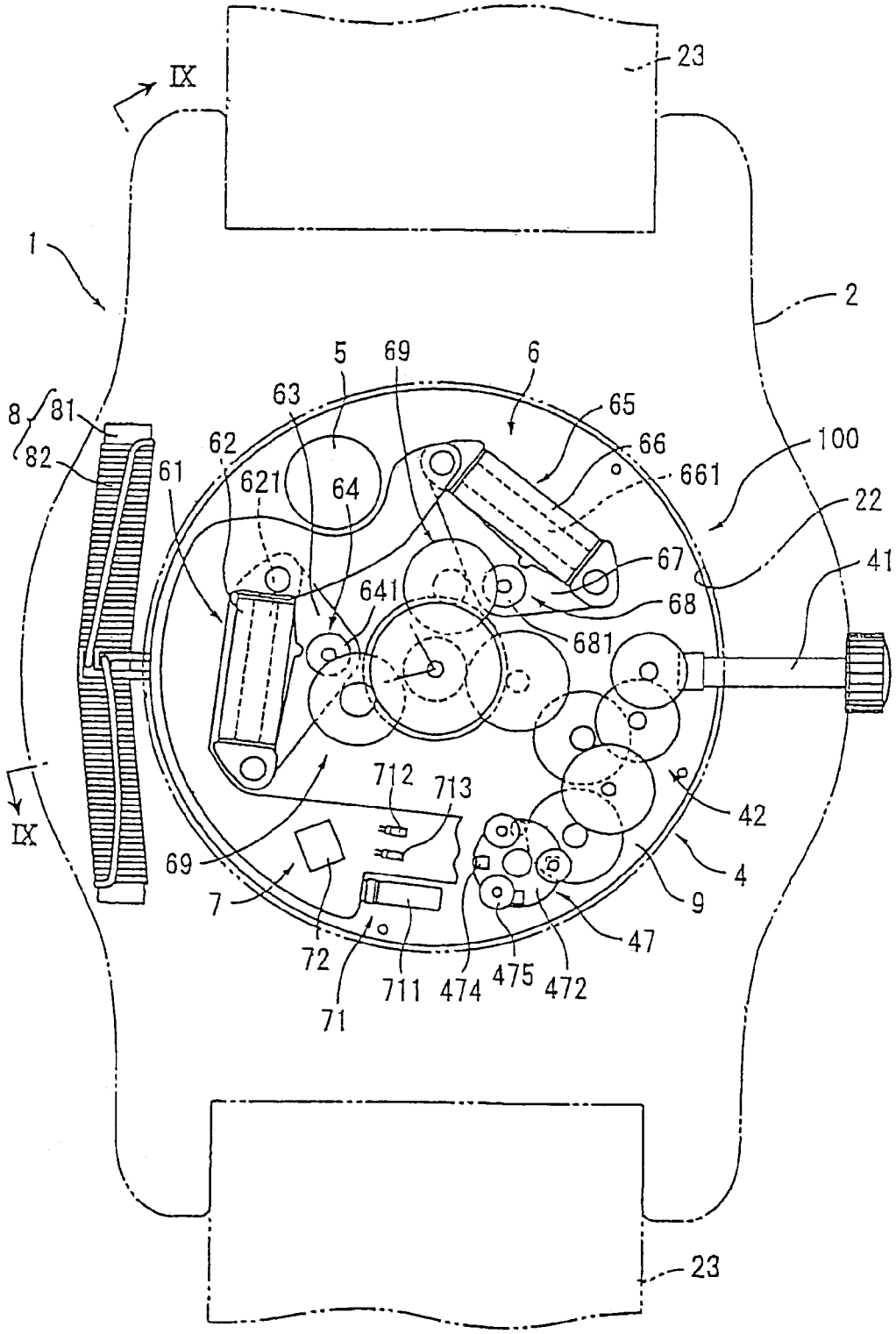
FIG. 7 is a view of the internal structure of a radio wave clock with a back lid removed off according to a fourth embodiment of the present invention.

FIG. 7 illustrates a radio wave clock 1 of the electronic timepiece according to the fourth embodiment of the present invention. The basic structure of the radio wave clock 1 is the same as that of the first embodiment, but the specific structure of a generator is different.

Figure 8:
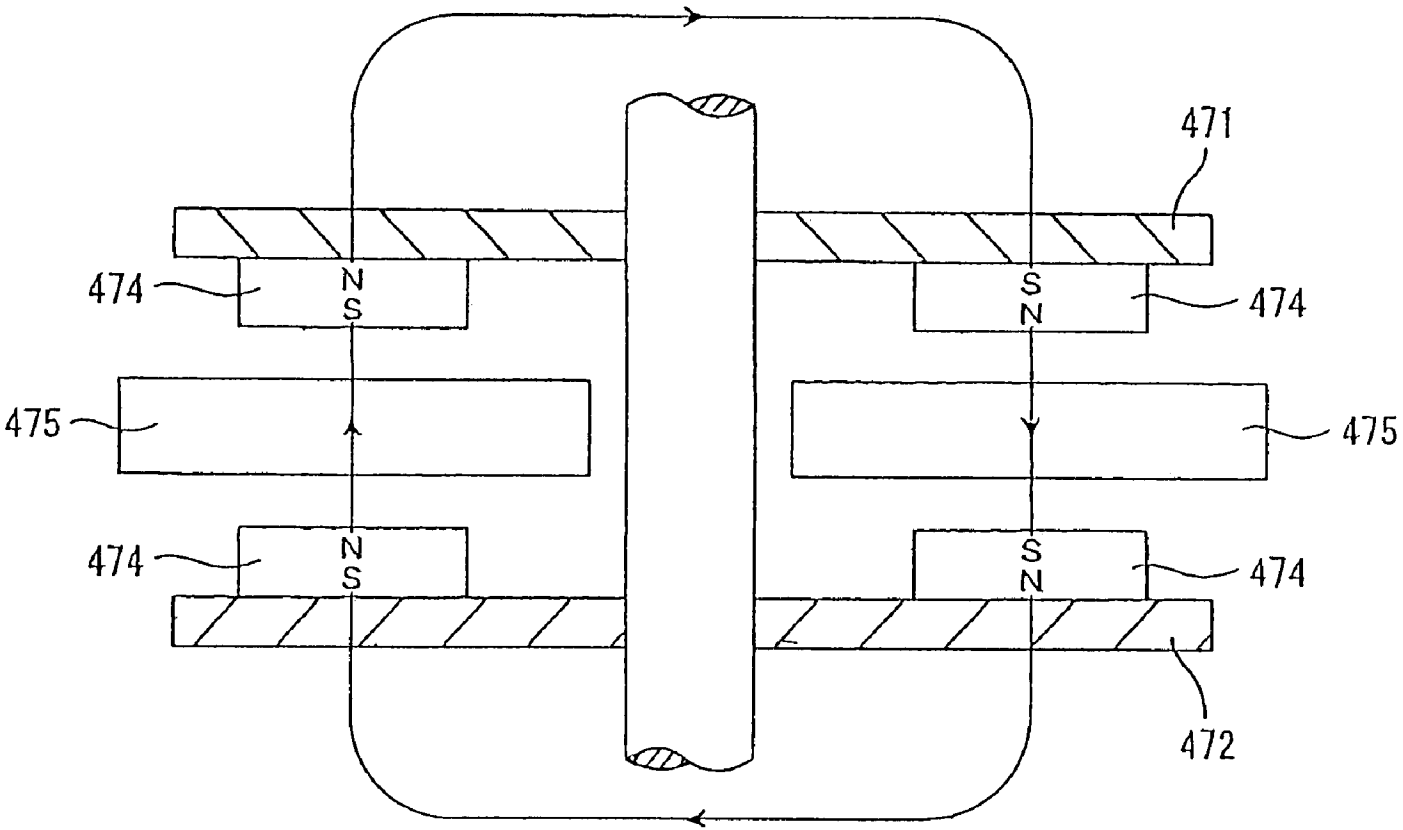
FIG. 8 is a cross-sectional view of a generator of the fourth embodiment.

As shown in the cross-sectional view of FIG. 8, a generator 47 of this embodiment is configured to include a pair of rotor circular plates 471, 472 which are rotated by the rotation (mechanical energy) transmitted by a power transmission part 42, and which are coaxially installed apart from each other by predetermined distance, magnets 474 installed facing each other on the four locations of the rotor circular plates 471, 472 at an angle of 90° relative thereto, and three coils 475 installed between the two rotor circular plates 471, 472.

The directions of the rotation axis of the rotor circular plates 471, 472 and the central axis of the coils 475 are perpendicular to the drawing sheet of FIG. 7. That is, the axial direction of the coils 475 is about perpendicular to the plane surface including a core 81 of an antenna 8.

Figure 9:
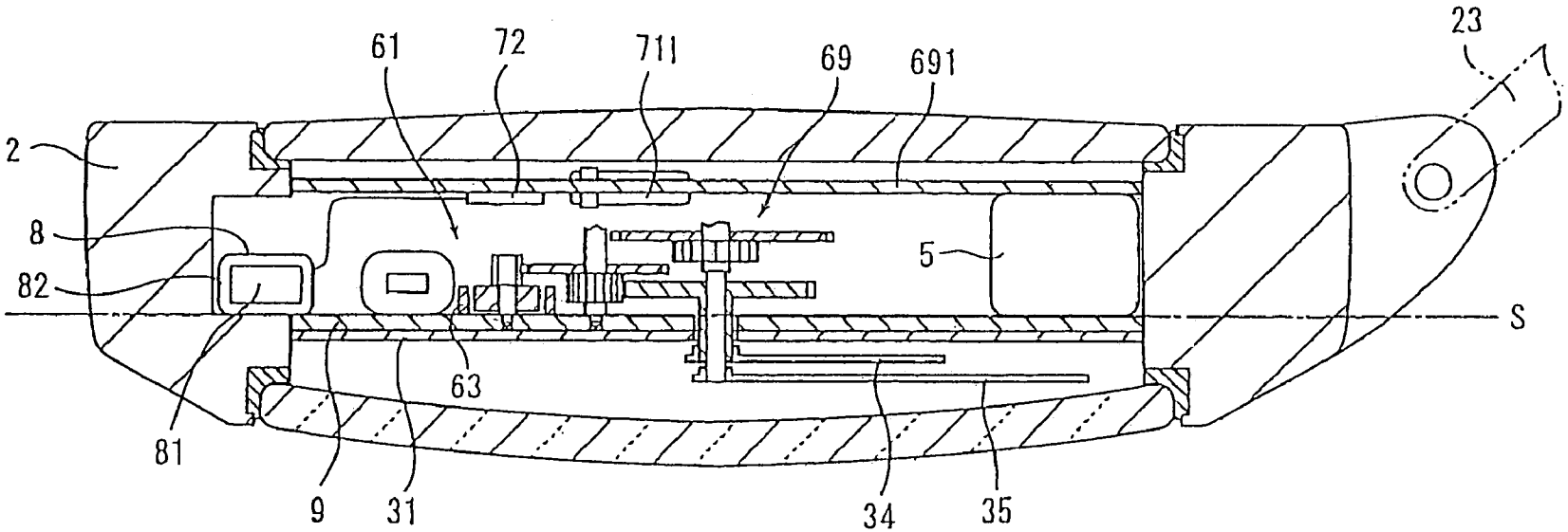
FIG. 9 is a cross-sectional view of the fourth embodiment taken along the line IX—IX of FIG. 7.

FIG. 9 is a cross-sectional view taken along the line IX—IX of FIG. 7. From the cross-sectional view of FIG. 9, the surface of the antenna 8 to a base plate 9, the surface of a driving motor 61 to the base plate 9, and the surface of a battery 5 to the base plate 9 are all placed at the same height on the surface S including the base plate 9.

In such structure, if a winding stem 41 is rotated by the winding manipulation by a human hand, power is transmitted by the power transmission part 42, and the rotor circular plates 471, 472 of the generator 47 are rotated. Along with the rotation of the rotor circular plates 471, 472, if the magnets 474 are rotated, since the magnetic flux density penetrating through the coil 475 is changed, current is generated in the coil 475.

According to the fourth embodiment, following effects can be achieved in addition to the effects similar to the effects (1), (2), and (4) of the each embodiment.

(10) Since the coil 475 of the generator 47 is almost perpendicular to the surface including the core 81 of the antenna 8, the antenna 8 is almost perpendicular to the magnetic flux of the magnetic field generated from the coil 475 of the generator 47. Therefore, since the antenna 8 does not follow the line of the magnetic flux of the magnetic field from the coil 475 of the generator 47, it is difficult for the magnetic field from the coil 475 of the generator 47 to interfere with the antenna 8, and the impact of the magnetic field from the coil 475 on the antenna 8 can be decreased so that the receiving sensitivity of the antenna 8 can be well improved.

(11) Since it is difficult for the magnetic flux of the magnetic field generated from the coil 475 of the generator 47 to interfere with the antenna 8, the magnetostriction for the antenna 8 can be suppressed. Therefore, a similar effect to the effect (2) of the first embodiment can be achieved.

(12) Since the antenna 8, a driving motor 61, and the battery 5 are placed at the same height, and those with a thickness do not overlap in the thickness direction inside the components of the clock, the thickness of the clock can be minimized.

Further, the components of the first, second, third, and fourth embodiments can be properly combined and used. For example, an intermediate gear 424 of the third embodiment and the generator 47 of the fourth embodiment can be combined.

EXAMPLE 5

Now, the electronic timepiece according to a fifth embodiment of the present invention will be explained in reference to FIGS. 10 to 12.

Figure 10:
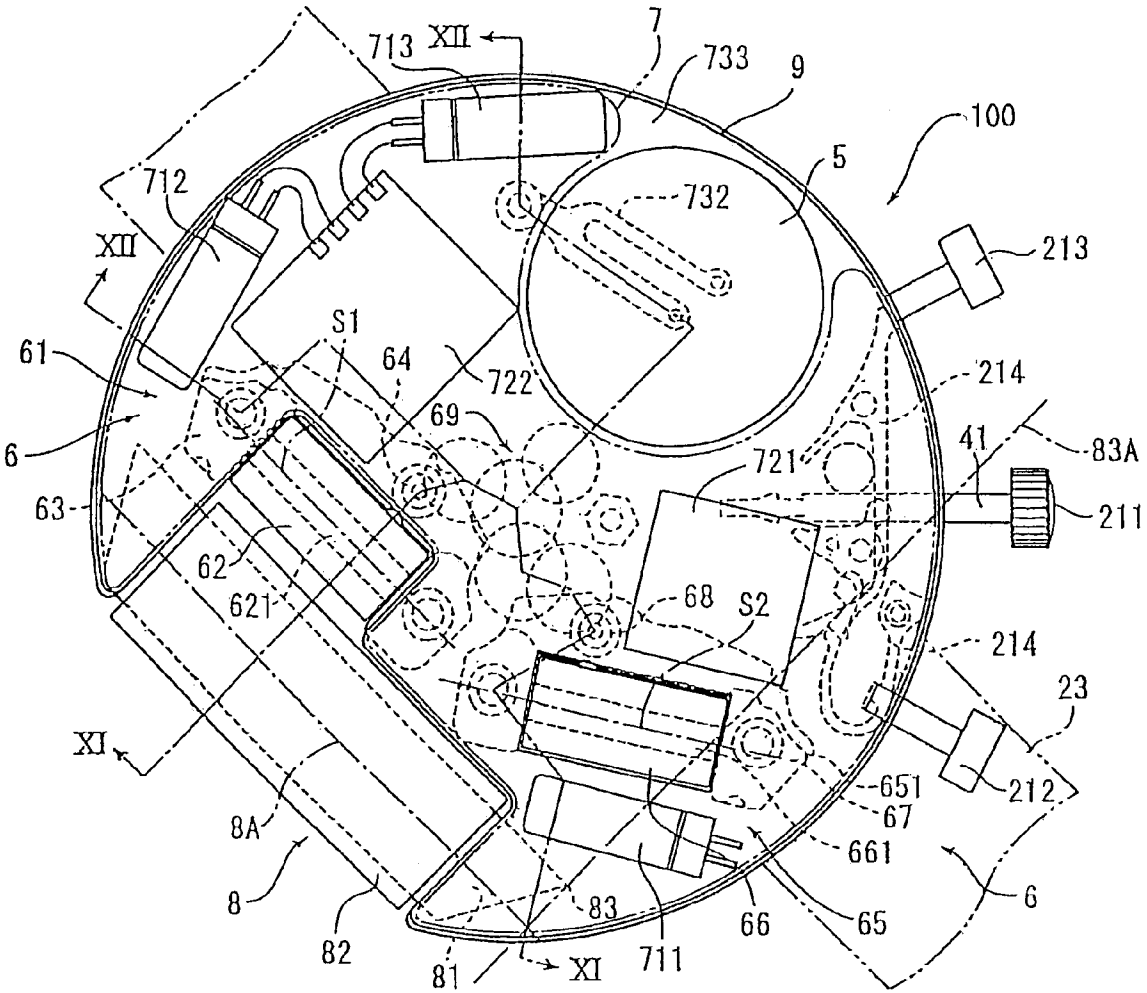
FIG. 10 is a plane view of a movement of the fifth embodiment from the view of a back lid.

FIG. 10 is a plane view of a movement 100 of the fifth embodiment from the view of a back lid. FIG. 11 is a cross-sectional view taken along the line XI—XI of FIG. 10. FIG. 12 is a sectional view taken along the line XII—XII of FIG. 10. Further, in FIG. 10, the upper direction of the sheet is 6 o'clock, and the lower direction of the sheet is 12 o'clock, and the right direction of the sheet is 3 o'clock.

The electronic timepiece includes a body case (not shown), being composed of a non-conductive material or a diamagnetic material, an external manipulation mechanism 21 for allowing the input manipulation from the outside of the body case, a movement 100 for clock received in the body case, and an antenna 8 for receiving standard radio waves including time information.

A time display part 3 for displaying time is installed on one surface (back surface of the sheet in FIG. 10) of the body case, and the time display part 3, being substantially circular-plate shaped, includes a dial installed to cover one surface of the body case, and hands (not shown) rotating on the dial. The hands include a second hand for indicating seconds, a minute hand for indicating minutes, an hour hand for indicating hours, etc. and in this embodiment, they move around almost the center of the body case as a center of rotation. A mounting hole (not shown) is formed on the back lid of the body case (not shown), for inserting a band 23 for clock, and the band 23 for clock is inserted in the mounting hole.

The external manipulation mechanism 21 is installed on the body case in the direction of about 3 o'clock, and includes a crown 211 capable of being protruded from or retracted to the body case, and rotatably installed about the axis, and an A button 212 and a B button 213 installed to be push-manipulatable on the body case.

The crown 211 is installed on one end of the winding stem 41 mounted on the trunk of the body case to be axially movable, and the crown 211 and the winding stem 41 are composed of a metallic member. The crown 211 is possibly put in and out at the three stages, that is, 0 state, 1 stage, 2 stage, and the input manipulation can be made by the position setting of the three stages.

The other end of the winding stem 41 is located inside the body case, and engaged with a latch as a lever member and a setting lever, etc. (not shown). The rotation of the axial center of the winding stem 41 is transmitted to the hands through a clutch wheel, a setting wheel, etc. (not shown), and the location of the hands can be corrected. The winding stem 41, the latch, the setting lever, the clutch wheel and the setting wheel are composed of carbon steel or stainless steel, etc.

The A button 212 and the B button 213 are installed about the crown 211 with the A button 212 in the direction of about 2 o'clock and the B button 213 in the direction of about 4 o'clock. The A button 212 and the B button 213 are engaged with a switch lever 214, and the switch lever 214 operates by the one-time push-manipulation of the A button 212 and the B button 213.

The movement for clock 100 includes a substantially true-circular shaped base plate 9 for mounting components for measuring time and an antenna 8 thereon. The base plate 9 as a base frame is composed of a non-conductive member (synthetic resin, ceramic, etc.), and is installed on the back surface of the dial inside the body case.

The movement 100 includes a wheel train part 69 coupled with the hands, for transmitting power to the hands, a driving portion 6 coupled with the wheel train part 69, for driving the hands, a battery 5 as a power source, a circuit block 7 having a control circuit, etc. mounted thereon, and a base plate 9 having the wheel train part 69, the driving portion 6, and the battery 5 mounted thereon. Further, the shape of the base plate 9 may be an elliptic shape or a rectangular shape as well as a circular shape.

The wheel train part 69 is installed substantially at the center of the base plate 9, and born by a wheel train bearing 691 installed opposite to the base plate 9, and the base plate 9. As such, the wheel train part 69 is placed at substantially the center position of the base plate 9, so that the rotation axis of the hands can be the center of the clock body. Then, since the rotation radius of the hands became large, and the displayed time can be easily seen.

The driving portion 6 includes a second hand driving motor 61 for driving the second hand, and a minute/hour hand-driving motor 65 for driving the minute/hour hands.

The second hand driving motor 61 includes a motor coil 62 to which a predetermined period of driving pulses are applied, a stator 63 for transmitting the magnetic flux generated in the motor coil 62, and a rotor 64 rotated by the magnetic flux transmitted from the stator 63. The minute/hour hand driving motor 65 includes a motor coil 66, a stator 67, and a rotor 68 similarly to the second hand driving motor.

The stators 63, 67 are composed of flat-shaped members of a high magnetic permeability such as permalloy, etc. Rotor pinions of the rotors 64, 68 are engaged with wheel train, and the rotation of the rotors 64, 68 is transmitted to the hands by the wheel train.

The motor coils 62, 66 are wound around the rod-shaped coil cores 621, 661 of high magnetic permeability material such as permalloy, etc., and have the number of turns enough to have antimagnetic performance and coil resistance, and are wound slender in the axial direction, not wound thick in the entire direction.

The minute/hour hand driving motor 65 is placed in the range from about 1 o'clock to about 2 o'clock relative to the wheel train part 69, with the 9 o'clock side end of the motor being oriented to the center of the clock body relative to a line parallel with the line binding 3 o'clock and 9 o'clock of the axis of the motor coil 66. The second hand driving motor 61 is placed in the range from about 11 o'clock to about 8 o'clock relative to the wheel train part 69, in parallel with the line binding 2 o'clock and 8 o'clock of the axis of the motor coil 62.

The battery 5 has a metallic outer can of a ferromagnetic material such as SUS304, etc., and is a secondary battery in which charge or discharge are possible. Further, the battery 5 can be used in a primary battery. Further, the energy source of the secondary battery can employ various types of power generation methods such as solar light power generation, solar heat power generation, power generation by temperature difference, power generation by electromagnetic conversion of kinetic energy, piezo-electric power generation, etc. The battery 5 is installed such that a part of the peripheral part of the battery 5 is placed close to the peripheral part of the base plate 9, in the range from about 4 o'clock to about 6 o'clock for the wheel train part 69. The battery 5 has a plus electrode to the back lid (outer side of the sheet in FIG. 10), and a minus electrode to the dial (back side of the sheet in FIG. 10).

Figure 12:
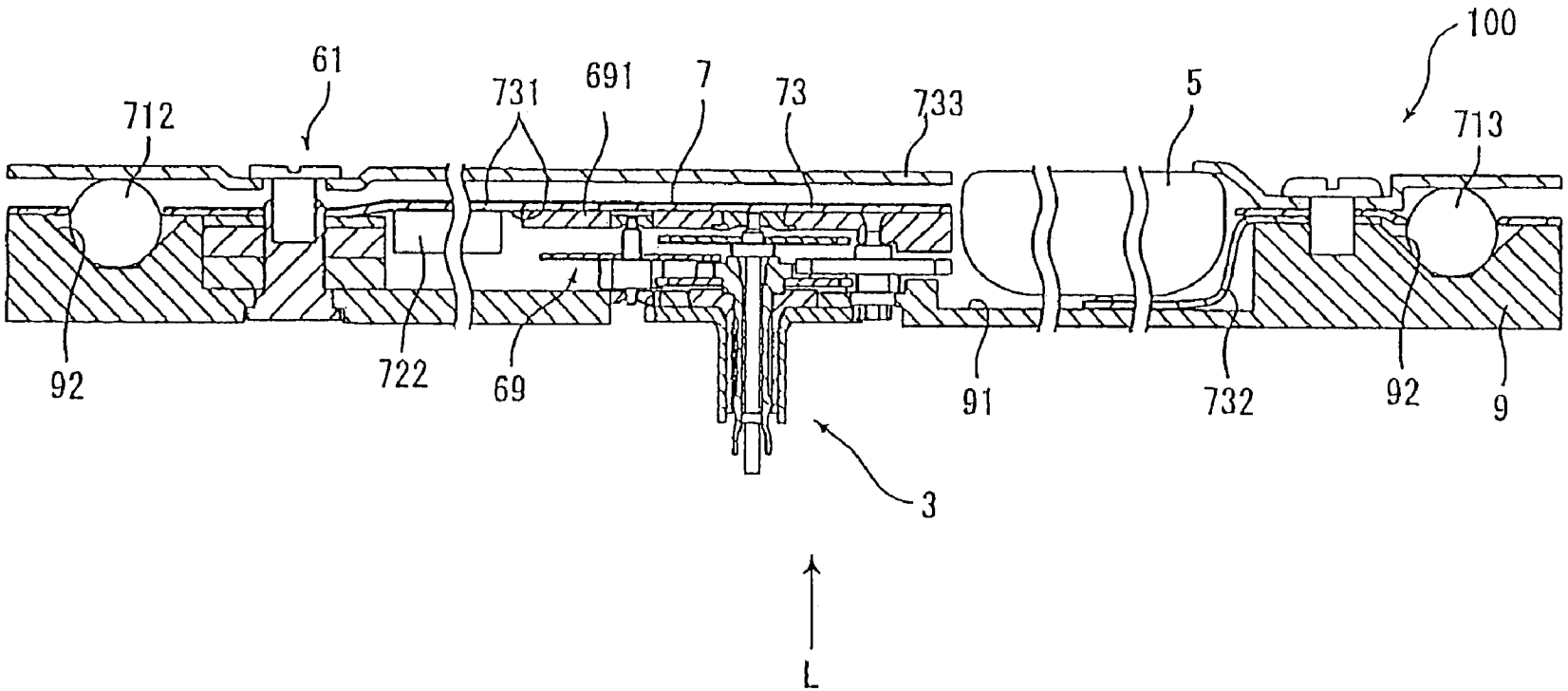
FIG. 12 is a cross-sectional view of the fifth embodiment taken along the line XII—XII of FIG. 10.

As shown in FIG. 12, a concave portion 91 is installed at the position corresponding to the battery 5 of the base plate 9, and the battery 5 is rest in the concave portion 91. Since the concave portion 91 is formed in the base plate 9, a large size of the battery 5 can be provided to increase the capacity of the battery 5. Further, in the motor coil 62, 66 of the driving motors 61, 65 consuming the most of the battery capacity, since the consumed energy can be reduced by winding with enough coil resistance, the thickness of the battery 5 can be made relatively thin because a small amount of battery capacitance is enough.

Figure 11:
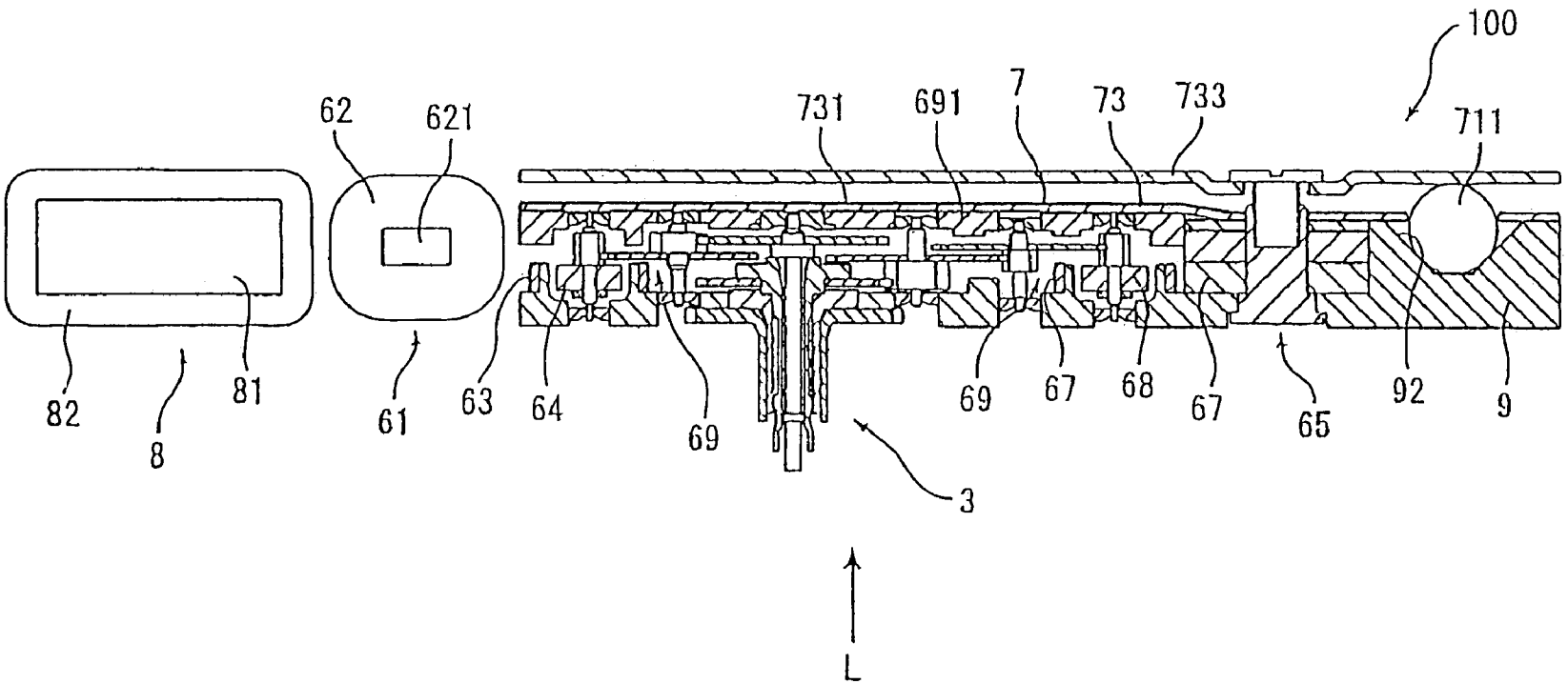
FIG. 11 is a cross-sectional view of the fifth embodiment taken along the line XI—XI of FIG. 10.

As shown in FIGS. 11 and 12, a circuit block 7 is placed on the surface opposite to the base plate 9 of the wheel train bearing 691. The circuit block 7 includes a circuit substrate 73, a wiring pattern 731 formed on the both in and out surfaces of the circuit substrate 73, a time-measuring IC 721 for measuring time and performing the driving control of the driving motors 61, 65, an IC 722 for reception-processing for reception-processing received standard radio waves, and crystal oscillators 711, 712, 713 for oscillating standard pulses.

The circuit substrate 73 is a flexible print substrate formed of synthetic resin such as polyimide, glass epoxy, etc. of flexibility, and has a substantially true-circle shape or a cut-out shape at the region corresponding to the battery 5 and at the edge region relative to the line binding about 1 o'clock to about 10 o'clock. The circuit substrate 73 includes an electrically-connectable wiring pattern 731 on both surfaces. Further, as shown in FIG. 12, on the surface of the circuit substrate 73 to the base plate 9 is there installed a terminal 732, which is connected to the negative electrode of the battery 5. The terminal 732 includes two spring parts having different length, and is gold-coated. By installing the two spring parts, since the pressing force to the battery 5 of the terminal 732 can be increased even though the terminal 732 is molded thin, chattering can be prevented. Further, because of the installation of the spring parts having different length, since natural frequencies between the spring parts are different, both of them are not resonated by the impact from the outside at the same time, and the electrical connection of at least one of the spring parts to the battery 5 can be achieved.

The circuit substrate 73 is interposed between a circuit receptacle seat (not shown) installed to the base plate 9 and a circuit pressing plate 733 installed to the back lid.

The circuit pressing plate 733 has substantially the same shape as the circuit substrate 73, and has a cut-out shape with its edge region relative to the line binding about 1 o'clock and about 10 o'clock removed from a true-circle shape, and is placed not to overlap the motor coils 62, 66 and the antenna coil 82.

The circuit pressing plate 733 is composed of a ferromagnetic material such as stainless steel (SUS), etc. and also functions as an electrostatic shielding member for electronic components, a light shielding member, an antimagnetic shielding member and a holding member for holding the location of each component of the electronic circuits.

Further, the circuit pressing plate 733 is connected to the positive electrode of the battery 5, and the positive electrode of the battery 5 is formed of a ground as a standard voltage for the electronic circuit of the movement 100.

The time-measuring IC 721 is installed on the surface of the circuit substrate 73 to the base plate 9, in the range from about 2 o'clock to about 3 o'clock for the wheel train part 69. The time-measuring IC 721 includes a current time counter for measuring current time according to the reference clock from the crystal oscillator 711, a time correction circuit for correcting the counting values of the current time counter according to the time information of the standard radio waves processed by the IC 722 for reception processing, and a motor driver for applying driving pulses to the motor coils 62, 66 and driving the hands according to the current time of the current time counter, etc. The time-measuring IC 721 has a thickness of about 0.1 mm to 0.3 mm, and the time-measuring IC 721 and the winding stem 41 partially overlap in the viewing direction of the time display part 3. Further, the viewing direction of the time display part 3 means the direction perpendicular to the sheet of FIG. 10, the direction as indicated by the arrow L in FIGS. 11 and 12, and the direction substantially perpendicular to the dial. Since the time-measuring IC 721 is thin, even if it is placed to overlap the winding stem 41, it does not affect the thickness of the clock, and just overlapped placement of the time-measuring IC 721 and the winding stem 41 can miniaturize the clock.

The IC 722 for reception is installed on the circuit substrate 73 to the base plate 9, in the range from about 9 o'clock to about 12 o'clock for the wheel train part 69. The IC 722 for reception includes an amplification circuit for amplifying the standard radio waves received by the antenna 8, a filter for extracting a desired frequency component, a demodulation circuit for demodulating signals, and a decode circuit for decoding signals, etc.

The crystal oscillator includes a time-measuring crystal oscillator 711 for oscillating a reference clock for time clock and tuning-signal crystal oscillators 712, 713 for generating tuning signals tuned to standard radio waves.

The time-measuring crystal oscillator 711 is installed on the opposite side to the time-measuring IC 721 with the minute/hour hand driving motor 65 between them, in the direction of about 11 o'clock for the wheel train part 69.

The tuning-signal crystal oscillators are a crystal oscillator 713 for 40 kHz for generating tuning signals tuned to standard radio waves of 40 kHz, and a crystal oscillator 712 for 60 kHz for generating tuning signals tuned to standard radio waves of 60 kHz, for example, in Japan. The IC 722 for reception selects a high level of receiving sensitivity in the comparison of the receiving sensitivity of 40 kHz of standard radio waves and the receiving sensitivity of 60 kHz of standard radio waves, and selects which one to use either the tuning-signal crystal oscillator 713 for 40 kHz, and the tuning-signal crystal oscillator 712 for 60 kHz. Further, the crystal oscillator of 60 kHz and the crystal oscillator of 77.5 kHz are used, for example, n Europe and America.

Further, the crystal oscillator 713 for 40 kHz is disposed along the circumferential edge of the base plate 9, in the direction of about 6 o'clock, and the crystal oscillator 712 for 60 kHz is disposed along the circumferential edge of the base plate 9, in the direction of about 9 o'clock. By installing the tuning-signal crystal oscillators 712, 713 on the circumferential edge of the base plate 9, a plurality of tuning-signal crystal oscillators can be installed. The tuning-signal crystal oscillators 712, 713 are placed adjacent to the IC 722 for reception and electrically connected thereto.

Concave portions 92 are provided in the base plate 9 on the locations corresponding to the tuning-signal crystal oscillators 711 to 713, and the tuning-signal crystal oscillators 711 to 713 are rested on the concave portions 92, respectively, the tuning-signal crystal oscillators 711 to 713 are biased toward the base plate 9 by the elastic force of the circuit pressing plate 733, and are positioned. The capsules of the tuning-signal crystal oscillators 711 to 713 contact the circuit pressing plate 733 so as to be in the same potential as that of the positive potential of the battery.

The antenna 8 includes a rod-shaped antenna core 81, being composed of ferrite, and an antenna coil 82 wound around the antenna core 81. The antenna 8 is placed in the range from about 12 o'clock to about 9 o'clock, and installed on the circumferential edge of the base plate 9 such that the axis of the antenna coil 82 is substantially parallel to the line binding from about 12 o'clock to about 9 o'clock. Further, the location of the base plate 9 corresponding to the antenna coil 82 is cut out.

The both ends of the antenna core 81 are preferably placed along the external circumference of the base plate 9.

Further, the antenna coil 82 is preferably wound in alignment. By such a structure, the external appearance of the clock is excellent. Further, the receiving sensitivity can be improved by aligning the vectors of interlink magnetic flux.

A copper wire, or a silver wire, etc. is illustrated as an example for a winding material.

The sectional shape of the coil of the antenna coil 82 is preferably substantially rectangular-shaped. Then, there is no gap between coils when winding the coil around the antenna core 81, as compared with a circular-shaped section of the coil. As a result, since the number of turns is increased and the coils can be densely wound without gap, the interlink magnetic flux is increased and concentrated so as to improve the receiving sensitivity. Further, it is possible to miniature the antenna 8 itself with the same number of turns. The radio wave correcting clock 1, itself can be miniaturized.

Further, in the case that the section of the coil of the antenna coil 82 is circular-shaped, when coils are wound around the antenna core 81, it can be preferably wound in the shape deformed into substantially a hexagon in a state deformed by the tensile stress within a plastic deformation region. Then, since the coils are wound in the honey comb-shape, there is no dead space so as to facilitate the miniaturization. Further, since the coils can be densely wound without gap, the interlink magnetic flux is concentrated and the receiving sensitivity can be improved.

Further, the coils of the antenna coil 82 are preferably placed externally along the circumference of the base plate.

The antenna 8 is placed opposite to the wheel train part 69 with the second hand driving motor 61 and the minute/hour hand driving motor 65 between them, and placed opposite to the battery 5 with the wheel train part 69, the second hand driving motor 61 and the minute/hour hand driving motor 65 between them. Further, in the case that large sized components are placed closely on the base plate 9, and the strength of the base plate 9 is decreased, but the strength of the base plate 9 can be held by disposing the battery 5 and the antenna 8 apart from each other.

The end 651 to 3 o'clock (to the winding stem) of the minute/hour hand driving motor 65 is protruded to 3 o'clock relative to the line 83A perpendicular to the antenna core 81 through the end 83 to 3 o'clock (to the winding stem) of the antenna 8. Further, the axis S1 of the motor coil 62 of the second hand driving motor 61 is substantially parallel to the axis 8A of the antenna coil 82, and the axis 82 of the motor coil 66 of the minute/hour hand-driving motor 65 is inclined at an angle of about 300 to the axis 8A of the antenna coil 82. Further, the axis S1 of the motor coil 62 of the second hand driving motor 61, and the axis S2 of the motor coil 66 of the minute/hour hand driving motor 65 are placed continuously substantially without gap so as to partition the battery 5 and the antenna 8.

Further, the winding stem 41 constituting the external manipulation mechanism 21 and the antenna 8 are placed on the base plate 9 separated from each other by a predetermined distance. Since the winding stem 41 and the antenna 8 are separated as above, even though the winding stem 41 is composed of a metallic member such as stainless steel, carbon steel, etc., the magnetic field from the winding stem 41 does not affect the antenna 8, and the receiving sensitivity of the antenna 8 can be improved.

Since the battery 5, the second hand driving motor 61, the minute/hour hand driving motor 65, the crystal oscillators 711 to 713, and the antenna 8 are placed at different locations on the same plane respectively, they are all installed on the non-overlapped locations two-dimensionally from the view of the time viewing direction L. That is, when projecting the battery 5, the second hand driving motor 61, the minute/hour hand driving motor 65, the crystal oscillators 711 to 713, and the antenna 8 from the view of the time viewing direction L, these projected images are different from each other and do not overlap each other. Further, in FIGS. 11 and 12, the surface of the antenna 8 to the back lid, the surface of the driving motors 61, 65 to the back lid, and the surface of the battery 5 to the back lid are placed at the same height on the same plane from the sectional view.

Further, as shown in FIGS. 11 and 12, the crystal oscillators 711 to 713 are preferably placed at the same height as the battery 5, the second hand driving motor 61, the minute/hour hand driving motor 65, and the antenna 8.

Further, in the case that a band 23 for clock is composed of a conductive material such as SUS(stainless steel), titanium alloy, gold alloy, brass, etc., the antenna 8 and the band 23 for the clock are preferably placed on the non-overlapped location from the view of the time viewing direction L. That is, from the view of the time viewing direction L, the band 23 for clock is installed substantially parallel to the axis of the antenna coil 82 in its longitudinal direction through substantially the center of the clock body. Further, the width of the band 23 for clock is formed not to overlap the antenna 8. In such structure, if the band for wristwatch is composed of a conductive material, standard radio waves are apt to be drawn into the band 23 for clock, but since the band 23 for clock and the antenna 8 do not overlap, the impact of the band 23 for clock on the interlink magnetic flux of the antenna 8 can be reduced.

Then, the operation of the radio wave clock 1 will be explained.

There are three modes for the operation mode, that is, a time display mode at the crown 0 stage, a time manual correcting mode at the crown 1 stage, and a hand 0-position correcting mode at the crown 2 stage.

In the time display mode at the crown 0 stage, current time is normally displayed. If the A button 212 is pressed for 2 or more seconds in this stage, the time display mode proceeds to a forced receiving mode of standard radio waves, and the standard radio waves is received. If the reception is completed, the time is corrected according to the received time information, and then, it proceeds to a normal needling. Even in the case that the reception of the standard radio waves is not successful, the clock can operate according to the needling of a normal counter for current time. Further, if the B button 213 is pressed, the former mode proceeds to a receiving confirmation mode. In the receiving confirmation mode, if the reception is successful within preceding several hours, a second hand is moved to a 30 seconds location (it is directed towards the number "6" on the dial 31) as a signal of the receiving confirmation. If the reception is not successful, the needling of the hands stops. The receiving confirmation mode lasts for 5 seconds, and then, it proceeds to a normal needling.

If the A button 212 is pressed once in the time hand-correcting mode at the crown 1 stage, the second hand is fast wound by one scale, and if the B button 213 is kept to press for a certain time, the second hand is fast wound at the pulse of 128 Hz. If the B button 213 is pressed once, the minute hand is fast wound by one scale, and if the B button 213 is kept to press for a certain time, the minute hand is fast wound at the pulse of 128 Hz.

If the A button 212 is pressed in the 0-position correcting mode at the crown 2 stage, the second hand is reset as 0. Further, if the B button 213 is pressed, the minute hand is reset to 0.

According to the fifth embodiment structured as above, the following effects can be achieved in addition to (12) effect of the above embodiments.

(13) Since the antenna 8, the minute/hour hand driving motor 65, the second hand driving motor 61, and the battery 5, which are relatively large in size among the components for the clock, do not overlap two-dimensionally, and are placed at the same height on the different locations of the same plane, the thickness of the clock can be minimized. Since the thickness of the clock can be minimized, when it is used as a portable clock such as a wristwatch, etc., the design or installation characteristics can be improved.

(14) The antenna 8 and the battery 5 are disposed on the opposite side to each other with the wheel train part 69, the minute/hour hand driving motor 65, and the second hand driving motor 61 between them, the magnetic field generated from the battery 5 can be shielded by the wheel train part 69 or the coil cores 621, 661 of the stators 63, 67 of the driving motors 61, 65. When the battery 5 is charged or discharged, since the change of the electric field occurs, and the magnetic field is generated, the magnetic field was the traveling direction on the plane surface including the antenna core 81 so that it easily interferes with the antenna 8. However, since the antenna 8 and the battery 5 are separated from each other, the magnetic field generated from the battery 5 does not affect the antenna 8, and the receiving sensitivity of the antenna 8 can be improved. Further, by disposing the wheel train part 69 or the driving motors 61, 65 in the space resulting from placing the antenna 8 and the battery 5 separated, the efficiency of space usage can be increased without dead space, and the miniaturization of clock can be achieved.

(15) The coil core 621 of the second hand driving motor 61 and the coil core 661 of the minute/hour hand driving motor 65 are placed between the antenna 8 and the battery 5, and installed at an angle of about 30° to or substantially parallel to the axis 8A of the antenna coil 82, and the battery 5 and the antenna 8 are separated by the coil cores 621, 661. Therefore, the magnetic field generated from the battery 5 can be substantially completely shielded by the coil cores 621, 661 so as to improve the receiving sensitivity of the antenna 8.

(16) Since the tuning-signal crystal oscillators 712, 713 and the IC 722 for reception are placed close to each other, the stray capacitance of wiring connecting the components is reduced, and when receiving standard radio waves, only standard radio waves from the radio waves received by the antenna 8 can be extracted precisely. Therefore, the time correction can be precisely performed by surely receiving a standard radio wave. Since the time correction can be precisely performed by surely receiving the time information, the crystal oscillator 711 for clock and the time-measuring IC 721 may be installed apart from each other, or they can be installed on the opposite sides to each other with the minute/hour driving motor 65 therebetween.

(17) Since the locations of the base plate 9, the circuit substrate 73, and the circuit pressing plate 733 corresponding to the antenna coil 82 are cut off, the antenna coil 82 can be wound thick without being interfered by the base plate 9. Therefore, the receiving sensitivity of the antenna 8 can be improved.

(18) Since the circuit pressing plate 733, being composed of a ferromagnetic substance, such as SUS is placed to overlap the battery 5, the magnetic field generated from the battery 5 is shielded by the circuit pressing plate 733, and the impact of the magnetic field from the battery 5 on the antenna 8 can be suppressed. In the case that it is preferable to dispose the battery 5 and the antenna 8 furthest apart from each other in the structure of the battery 5 and the antenna 8, the separated distance between the battery 5 and the antenna 8 is one factor to define the outer look of the clock. By installing the circuit pressing plate 733, it is possible to install the battery 5 and the antenna 8 closely so as to minimize the size of the clock.

Further, the electronic timepiece and the electronic apparatus of the present invention are not limited to the embodiment as described above, and various modifications can be possible within the scope without departing the spirit of the present invention.

As the power-generation mechanism 4, it is not limited to the structure for achieving mechanical energy by rotating the winding stem 41 in the above embodiments, but it is possible to provide, for example, a structure for achieving mechanical energy by the rotation of a rotary weight as an input device of mechanical energy. If the rotation of the rotary weight is transmitted to a gear train, etc., generators 43, 47 can generate.

In the first embodiment, the angle at which the central axis 8A of the antenna 8 and the central axis 46A of the power-generation coil 46 are crossed may be in the range from 60° to 120° and is preferably about 90°. In such structure, since the magnetic flux of the magnetic field from the power-generation coil 46 does not follow the antenna 8, the magnetic field hardly affects the antenna 8.

Further, the antenna 8 and the power-generation coil 46 are not disposed on the same plane, and may be crossed three-dimensionally. For example, as seen from the direction of viewing the time on the time display part 3, the central axis 8A of the antenna 8 and the central axis 46A of the power-generation coil 46 may be crossed at an angle from 60° to 120° in the projection surface.

In the first to fourth embodiments, the power-generation mechanism 4 may be configured to be detachable from the body case 2.

In each embodiment, the number of the hand driving motor or the secondary battery is not particularly limited but one, or more can be possible.

The magnetic field shielding member is not limited to the coil cores 621, 661 for motor or the case of the secondary battery 5, but for example, a magnetic shielding material for shielding magnetic field can be newly installed. The magnetic field shielding member may employ various alloy such as steel, nickel, or permalloy, and a ferromagnetic substance is good.

In the above embodiments, the coil core 621 of the second hand driving motor 61 and the coil core 661 of the minute/hour hand driving motor 65 may be composed of cobalt group of amorphous metal wherein Co is more than 50 wt %. The stator 64 for second hand motor and the stator 67 for minute/hour hand motor can be composed of steel group of amorphous metal wherein steel is more than 50 wt %. Such an amorphous metal has high magnetic permeability, the coil core 621, the coil core 661, the stator 64 for second hand motor, and the minute/hour hand motor 67 can be used as the magnetic field shielding member. Further, if the coil core 621, and the coil core 661 are composed of an amorphous metal wherein Co is more than 50 wt %, the core loss is prevented and the efficiency of motors can be increased.

In the present invention, the antenna 8 can be shielded from the magnetic field generated by the internal component members inside the radio wave clock. As a generating source of magnetic field, there are also, for example, a transformation coil used to transform and charge alternating current from a commercial power source, etc. as well as the generating coil of the generator. As the transformation coil, for example, a motor coil of a stepping motor can be used.

While receiving wireless information by the antenna 8, the hand driving motor may stop its driving. As such, if stopping the current of the hand driving motor during the reception of wireless information, the magnetic field generated from the hand driving motor does not overlap the antenna 8, and the magnetic field from the generating coil can be efficiently shielded by the coil for motor of the hand driving motor. Incidentally, since it is better that current necessary to drive the hands may be intermittent and weak, even if such current flows into the hand driving motor, the magnetic field generated from the coil for motor is weak, and it functions as the magnetic field shielding means sufficiently.

In the first, third, and fourth embodiments, during the reception of wireless information, the second hand driving motor 61 stops its driving, whereas the minute/hour hand driving motor 65 can keep its driving. Since the minute/hour hand driving motor 65 is placed further apart from the antenna 8 than the second hand driving motor 61, the magnetic field generated from the minute/hour hand driving motor 65 hardly affect the reception of the antenna 8. In this case, even during the reception of wireless information, current time for minute/hour can be displayed.

In each embodiment, the time display part 3 may be to display time by driving hands, or to display time by driving a disk plate. The hands of the time display part 3 may be directly attached on the rotor axis of the hand driving motor, or the hands or the disk plate may be driven by transmission means such as a wheel train part or a timing belt, etc. from the hand driving motor.

In each embodiment, the antenna 8 and the dial 31 may be placed to overlap. By such a structure, since the dial 31 is made large, the hands can be lengthened made as long as possible. As a result, time can be displayed enough to be easily seen. Since the dial 31, itself is thin, even in the case that the antenna 8 and the dial 31 overlap, if the antenna 8, the electromagnetic motor (second hand driving motor 61, minute/hour hand driving motor 65), secondary battery 5 are disposed not to overlap in the thickness direction, the clock can be made thin as a whole.

In the fifth embodiment, it is described about the case in which the end of the minute/hour hand driving motor 65 to 3 o'clock is protruded, through the end of the antenna 8 to 3 o'clock, out of 3 o'clock relative to the line perpendicular to the antenna core 81, but the end of the second hand driving motor 61 may be protruded, through the end of the antenna 8, out of the antenna 8 relative to the line perpendicular to the antenna core 81. As such, if the ends of the driving motors 61, 65 are protruded out of the end of the antenna 8, it more surely prevents the magnetic field generated from the battery 5 from interlinking the antenna 8 so as to improve the receiving sensitivity of the antenna 8.

In each embodiment, the antenna core may be composed of amorphous metal. A plurality of amorphous metal plates, being thin-flat typed, 0.01 mm to 0.05 mm in thickness, and being slender, can be stacked, and the plate is composed of, for example, amorphous metal of Co more than 50 wt %. If the thickness of the amorphous metal plate is thicker than 0.05 mm, since the central region of the plate-pressing is difficult to cool rapidly, metal is crystallized without being made amorphous. That is, to fabricate amorphous metal, it is necessary to perform rapid cooling before the metal is crystallized, and therefore, it is necessary to make the metal thin in thickness. Further, if the thickness of the amorphous metal plate is thinner than 0.01 mm, since the strength of the amorphous metal plate is weak during the assembling process and be vulnerable to deformation, it is very difficult to perform the positioning process of components, or to handle components, etc.

The thickness of the amorphous metal plates is substantially all the same, but the width of the amorphous metal plates stacked on the upper and lower sides in the stacked direction becomes gradually narrower than the amorphous metal plates stacked on the middle. The amorphous metal plates are stacked each other by insulating adhesives of epoxy group of resin, etc. The sectional shape of the stacked antenna core may be made substantially elliptic. Therefore, since it is possible to freely change the shape of the antenna core, which is relatively large in size among the clock components, it is easy to change the outer look of the movement, and the design characteristics of the clock can be improved.

The present invention is not limited to a radio wave clock, but it can be employed in an electronic timepiece having the power-generation mechanism 4 for converting mechanical energy into electrical energy and the antenna 8, and receiving wireless information. Further, it may be an electronic apparatus without a clock device. Further, it can be applied to various electronic apparatus such as a portable transmitter, a portable radio or a music box, a mobile phone, an electronic notebook, etc. For example, the measurement results of physical characteristics such as atmospheric pressure, gas density, voltage, current, etc. can be received as wireless information, and the electronic apparatus receiving the wireless information can drive the hands, and can display the measurement as analog.

Further, the wireless information is not limited to time information by long wave standard radio waves. For example, it may include wireless information of FM, GPS, bluetooth, or non-contact IC card, and also include wireless information of news, weather reports, stock information, etc.

If the received external wireless information is, for example, a weather report, it can be displayed by making a clock hand show pre-prepared indications such as fine, cloudy, rain, or the news or stock information can be displayed by using a display apparatus such as a liquid crystal display device, etc.

Further, the above modifications may be combined properly, or can be combined with each embodiment properly.

Industrial Applicability

As described above, the electronic timepiece and the electronic apparatus of the present invention are useful as an electronic apparatus such as an electronic timepiece having a function to receive wireless information, and particularly, and it is useful as a radio wave correcting clock for improving the receiving sensitivity of the antenna as well as having miniaturized and thin-flat type.

The invention claimed is:

1. An electronic timepiece comprising:

a radio wave receiving antenna for receiving radio waves;

at least one electromagnetic motor for driving a time display part, said electromagnetic motor having a stator and a coil core with a motor coil wound around it;

at least one power source; and wherein the antenna, the electromagnetic motor, and the power source do not overlap as viewed along the viewing direction of the time display part; and wherein said motor coil of said at least one electomagnetic motor is situated between said radio wave receiving antenna and said stator.

2. The electronic timepiece according to claim 1, wherein the antenna, the electromagnetic motor, and the power source are placed on a common plane that is substantially perpendicular to the viewing direction of the time display part.

3. The electronic timepiece according to claim 1, wherein the antenna and the power source are separated from each other, with the electromagnetic motor placed between them.

4. The electronic timepiece according to claim 1, wherein the electromagnetic motor includes:

a first electromagnetic motor for driving a minute/hour hand; and a second electromagnetic motor for driving a second hand; wherein the first electromagnetic motor and the second electromagnetic motor are positioned between the power source and the antenna; and wherein the power source, the antenna, the first electromagnetic motor, and the second electromagnetic motor are arranged on a common plane.

5. The electronic timepiece according to claim 1, further comprising:

a tuning-signal crystal oscillator for generating tuning signals tuned to the radio waves; and a reception processing circuit for processing radio waves received by the antenna;

wherein the tuning-signal crystal oscillator and the reception processing circuit are installed proximate to each other; and wherein the reception processing circuit, the tuning-signal crystal oscillator, the power source, the antenna, and the electromagnetic motor do not overlap each other as viewed along the viewing direction of the time display part.

6. The electronic timepiece according to claim 1, further comprising:

a circuit substrate having conduction patterns on both surfaces thereof; and a circuit pressing plate for pressing the circuit substrate toward the base plate, said circuit pressing plate being made of a ferromagnetic material.

7. The electronic timepiece according to claim 1, wherein the radio waves comprise at least a time code, and the electronic timepiece is a radio wave correction clock for receiving the radio waves to correct the time of a time-measuring mechanism in accordance with the time code.

8. The electronic timepiece of claim 1, wherein the time display part is driven via a wheel train, said wheel train being placed substantially at the center of said base frame, and said electromagnetic motor being placed between said radio reception antenna and said wheel train.

9. The electronic timepiece of claim 1, wherein the coil core of said electromagnetic motor has a length that is shorter than that of a core of said radio reception antenna.

10. The electronic timepiece of claim 1, wherein the driving operation of said electromagnetic motor is suspended while a reception operation by said radio reception antenna is in progress.

11. The electronic timepiece of claim 1, further comprising a base frame having the electromagnetic wave receiving antenna, the electromagnetic motor, and the power source installed thereon, said base frame being made of non-conductive material.

12. A timepiece comprising:

a radio reception antenna for receiving radio waves;

at least one electromagnetic motor for driving a time indicating unit via a wheel train, said time indicating unit having a time display face;

at least one power source; and a time correction mechanism having a winding stem made of a magnetizable metal member;

wherein said time correction mechanism, said radio reception antenna, said electromagnetic motor and said power source are arranged such that when seen from a direction from which said display face is viewed, their profiles are spaced apart from each other;

wherein said time correction mechanism, said radio reception antenna, and said power source are placed along the periphery of a base plate;

wherein the electromagnetic motor is placed further inward from the periphery of the base plate than, said time correction mechanism, said radio reception antenna and said power source.

13. The electronic timepiece according to claim 12, further comprising a time correction mechanisms, wherein:

the power source and the time correcting mechanism are proximate to each other and are placed along the periphery of the base frame, and the antenna and the power source are separated from each other by a first predetermined distance, and the antenna and the time correction mechanism are disposed so as to be separated from each other by a second predetermined distance.

14. The timepiece of claim 12, further comprising a wheel train positioned substantially at the center of the base plate.

15. The timepiece of claim 14, wherein said wheel train is located between said radio reception antenna and said time correction mechanism.

16. The timepiece of claim 12, further comprising a time-keeping control circuit that controls said electromagnetic motor, wherein said time-keeping control circuit and said time correction mechanism are arranged in such a manner that when seen from the direction that the time indicating unit is viewed, their outlines overlap at least partially.

17. The timepiece of claim 12, further comprising:

a tuning-signal crystal oscillator for generating tuning signals tuned to the radio waves; and a reception processing circuit for processing radio waves received by the antenna;

wherein the tuning-signal crystal oscillator and the reception processing circuit are installed proximate to each other; and wherein the reception processing circuit, the tuning-signal crystal oscillator, the power source, the antenna, and the electromagnetic motor do not overlap each other as viewed along the viewing direction of the time indicating unit.

18. The timepiece of claim 12, further comprising:

a circuit substrate having conduction patterns on both surfaces thereof; and a circuit pressing plate for pressing the circuit substrate toward the base plate, said circuit pressing plate being made of a ferromagnetic material.

* * * * *